US010280596B2

(12) United States Patent
Iwasaki

(10) Patent No.: US 10,280,596 B2
(45) Date of Patent: May 7, 2019

(54) HYDRAULIC CIRCUIT FOR CONSTRUCTION MACHINERY

(71) Applicant: NABTESCO CORPORATION, Tokyo (JP)

(72) Inventor: Hitoshi Iwasaki, Kobe (JP)

(73) Assignee: NABTESCO CORPORATION, Tokyo (JP)

( * ) Notice: Subject to any disclaimer, the term of this patent is extended or adjusted under 35 U.S.C. 154(b) by 179 days.

(21) Appl. No.: 15/116,385

(22) PCT Filed: Feb. 5, 2015

(86) PCT No.: PCT/JP2015/053167
§ 371 (c)(1),
(2) Date: Aug. 3, 2016

(87) PCT Pub. No.: WO2015/119175
PCT Pub. Date: Aug. 13, 2015

(65) Prior Publication Data

US 2017/0022687 A1 Jan. 26, 2017

(30) Foreign Application Priority Data

Feb. 5, 2014 (JP) ..... 2014-020281

(51) Int. Cl.
*F15B 11/17* (2006.01)
*E02F 9/22* (2006.01)
(Continued)

(52) U.S. Cl.
CPC ..... *E02F 9/2282* (2013.01); *E02F 3/42* (2013.01); *E02F 9/0883* (2013.01);
(Continued)

(58) Field of Classification Search
CPC ..... E02F 3/42; E02F 9/2282; E02F 9/2292; E02F 9/0883; E02F 9/2296; F15B 13/06;
(Continued)

(56) References Cited

U.S. PATENT DOCUMENTS 6,799,424 B2 * 10/2004 Ioku ..... E02F 9/2292 340/463
8,972,122 B2 * 3/2015 Magaki ..... E02F 9/2214 701/50
2013/0129459 A1 * 5/2013 Saotome ..... E02F 9/2239 414/687

FOREIGN PATENT DOCUMENTS

EP 0 791 754 A1 8/1997
EP 2 685 010 A1 1/2014
(Continued)

OTHER PUBLICATIONS

Extended European Search Report EP Application No. 15746552.7 dated Sep. 8, 2017.
(Continued)

*Primary Examiner* — Thomas E Lazo
(74) *Attorney, Agent, or Firm* — Pillsbury Winthrop Shaw Pittman, LLP

(57) ABSTRACT

Cost for a direction switching valve (third direction switching valve) is reduced while oil is supplied from two pumps to one actuator (third actuator).
A hydraulic circuit 30 for construction machinery includes a first unloading passage 31 connected with a first pump 11, a second unloading passage 32 connected with a second pump 12, a first supply passage 41 connected with the first pump 11, a second supply passage 42 connected with the second pump 12, a third supply passage 43, and third direction switching valves (53E and 53F). The third supply passage 43 is connected with the first supply passage 41 and the second supply passage 42. The third direction switching valves are
(Continued)

connected with the third supply passage 43, the first unloading passage 31, the second unloading passage 32, and the tank passage 35, and supply and discharge oil to and from the third actuators (23E and 23F).

24 Claims, 11 Drawing Sheets

(51) Int. Cl.

| | |
|---|---|
| ***E02F 3/42*** | (2006.01) |
| ***E02F 9/08*** | (2006.01) |
| ***F15B 1/26*** | (2006.01) |
| ***F15B 13/06*** | (2006.01) |

(52) U.S. Cl.
CPC ..... *E02F 9/2292* (2013.01); *E02F 9/2296* (2013.01); *F15B 1/26* (2013.01); *F15B 11/17* (2013.01); *F15B 13/06* (2013.01); *F15B 2211/20546* (2013.01); *F15B 2211/20576* (2013.01); *F15B 2211/305* (2013.01); *F15B 2211/31582* (2013.01); *F15B 2211/45* (2013.01); *F15B 2211/7051* (2013.01)

(58) Field of Classification Search
CPC .... F15B 1/26; F15B 11/17; F15B 2211/7051; F15B 2211/305
See application file for complete search history.

(56) References Cited

FOREIGN PATENT DOCUMENTS

| | | | |
|---|---|---|---|
| JP | S57-18061 | U | 1/1982 |
| JP | H02-112753 | U | 9/1990 |
| JP | H10-18360 | A | 1/1998 |
| JP | 2006-161510 | A | 6/2006 |
| WO | WO 2009/123047 | A1 | 10/2009 |

OTHER PUBLICATIONS

International Search Report as issued in International Patent Application No. PCT/JP2015/053167, dated Apr. 21, 2015.
Communication pursuant to Article 94(3) dated Aug. 3, 2018, issued in corresponding EP Application No. 15746552.7.

* cited by examiner (KNOWN TECHNOLOGY)

(KNOWN TECHNOLOGY)

HYDRAULIC CIRCUIT FOR CONSTRUCTION MACHINERY

CROSS-REFERENCE TO RELATED APPLICATIONS

This application is the U.S. National Stage of PCT/JP2015/053167, filed Feb. 5, 2015, which in turn claims priority to Japanese Patent Application No. 2014-020281, filed Feb. 5, 2014. The contents of all of these applications are incorporated herein by reference in their entireties.

TECHNICAL FIELD

The present invention relates to a hydraulic circuit for construction machinery.

BACKGROUND ART

There has been a known hydraulic circuit in which oil is supplied from two pumps to one actuator (see e.g., Patent Literature 1). The hydraulic circuit recited in Patent Literature 1 includes direction switching valves (32, 34A, 34B, 34C, and 34D) of a first system configured to supply and discharge oil ejected from a first pump (10) to and from an actuator and direction switching valves (42, 44A, 44B, and 44C) of a second system configured to supply and discharge oil ejected from a second pump (12) to and from the actuator. In this hydraulic circuit, the oil ejected from the first pump (10) and the second pump (12) is supplied to a boom cylinder (24B). To the boom cylinder (24B), the direction switching valve (34C) of the first system and the direction switching valve (44B) of the second system are connected. To an arm cylinder (24C), the oil ejected from the first pump (10) and the second pump (12) is supplied. To the arm cylinder (24C), the direction switching valve (34D) of the first system and the direction switching valve (44C) of the second system are connected.

CITATION LIST

Patent Literatures

[Patent Literature 1] Japanese Unexamined Patent Publication No. 10-18360

SUMMARY OF INVENTION

Technical Problem

As described above, in the known technology, two direction switching valves are connected with one actuator to supply oil from two pumps to one actuator. This arrangement is disadvantageous in the costs for manufacturing the direction switching valves.

An object of the present invention is to provide a hydraulic circuit for construction machinery, in which costs for direction switching valves are reduced even if oil is supplied from two pumps to one actuator.

Solution to Problem

A hydraulic circuit for construction machinery of each of the first and second aspects of the invention is connected with a first pump, a second pump, a tank, and actuators. The hydraulic circuit includes a first unloading passage connected with the first pump; a second unloading passage connected with the second pump; a first supply passage connected with the first pump; and a second supply passage connected with the second pump. Furthermore, the hydraulic circuit includes a tank passage, a first direction switching valve, and a second direction switching valve. The tank passage is connected with the first unloading passage, the second unloading passage, and the tank. The first direction switching valve is connected with the first supply passage, the first unloading passage, and the tank passage to supply and discharge oil to and from a first actuator. The second direction switching valve is connected with the second supply passage, the second unloading passage, and the tank passage to supply and discharge oil to and from a second actuator.

The hydraulic circuit of the first aspect is provided with the third supply passage and the third direction switching valve. The third supply passage is connected with the first supply passage and the second supply passage. The third direction switching valve is connected with the third supply passage, the first unloading passage, the second unloading passage, and the tank passage to supply and discharge oil to and from a third actuator.

The hydraulic circuit of the second aspect is provided with a boom supply passage, a boom direction switching valve, an arm supply passage, and an arm direction switching valve. The boom supply passage is connected with the first supply passage and the second supply passage. The boom direction switching valve is connected with the boom supply passage, the first unloading passage, the second unloading passage, and the tank passage to supply and discharge oil to and from a boom cylinder. The arm supply passage is connected with the first supply passage and the second supply passage. The arm direction switching valve is connected with the arm supply passage, the first unloading passage, the second unloading passage, and the tank passage to supply and discharge oil to and from an arm cylinder.

Advantageous Effects of Invention

According to the above-described first aspect of the invention, cost for a direction switching valve (third direction switching valve) is reduced while oil is supplied from two pumps to one actuator (third actuator).

According to the above-described second aspect of the present invention, cost for direction switching valves (a boom direction switching valve and an arm direction switching valve) is reduced even if oil is supplied from two pumps to one arm cylinder and oil is supplied from two pumps to one boom cylinder.

DESCRIPTION OF EMBODIMENTS

First Embodiment

Figure 1:
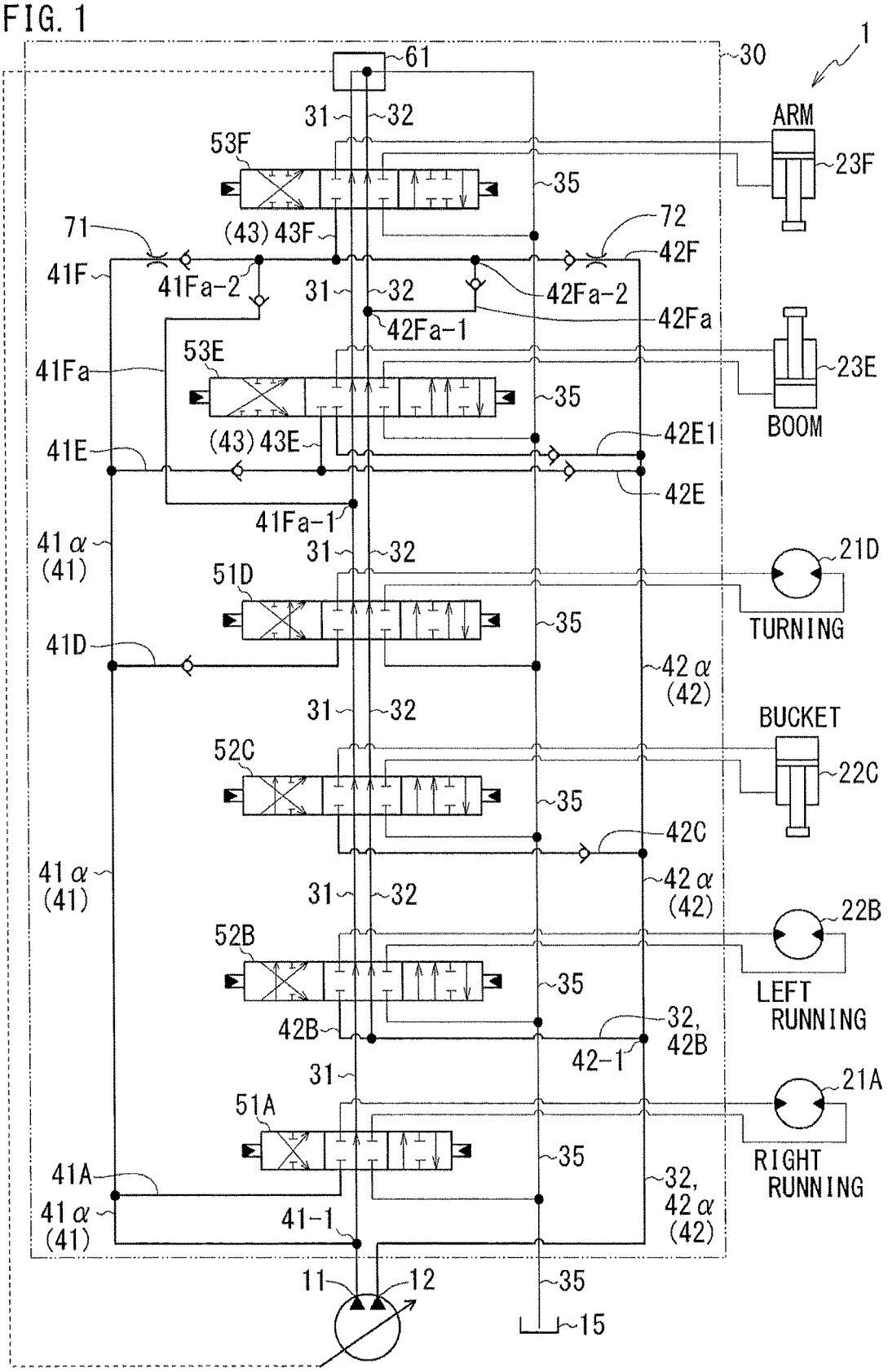
FIG. 1 is a hydraulic circuit diagram of a hydraulic circuit 30 for construction machinery, which is provided in a construction machine 1.

A construction machine 1 including a hydraulic circuit 30 for construction machinery shown in FIG. 1 will be described with reference to FIG. 1 to FIG. 5.

The construction machine 1 is a machine for construction. An example of the construction machine 1 is a hydraulic excavator. The construction machine 1 includes pumps (11 and 12), a tank 15, actuators (21A, 22B, 22C, 21D, 23E, and 23F) (hereinafter, actuators (21A to 23F)), and a hydraulic circuit 30 for construction machinery.

The pumps (11 and 12) are hydraulic pumps ejecting oil (pressure oil or hydraulic oil). Each of the pumps (11 and 12) is a variable capacity type. In each of the pumps (11 and 12), the capacity is varied as the tilt angle of a swash plate is varied, and as the capacity is varied, an ejection amount (i.e., an ejection amount of oil per one rotation of an input axis) is varied. The pumps (11 and 12) are formed of two pumps. The pumps (11 and 12) are formed of the first pump 11 and the second pump 12. The pumps (11 and 12) constitute a split pump, for example. The split pump is provided with a single input axis and plural pumps (the first pump 11 and the second pump 12) are driven by the single input axis. In the split pump, the first pump 11 and the second pump 12 are combined. In the split pump, the ejection amount of the first pump 11 is identical with the ejection amount of the second pump 12. The pumps (11 and 12) may not constitute a split pump. The first pump 11 and the second pump 12 may be separate pumps. The first pump 11 and the second pump 12 may share a single input axis or have different input axes. The ejection amount of the first pump 11 and the ejection amount of the second pump 12 may be identical with each other or may be different from each other.

The tank 15 stores oil. The tank 15 supplies oil to the pumps (11 and 12). To the tank 15, oil ejected from the pumps (11 and 12) and passing through the actuators (21A to 23F) returns. To the tank 15, oil ejected from the pumps (11 and 12) and not passing through the actuators (21A to 23F) returns.

The actuators (21A to 23F) drive the construction machine 1. Each of the actuators (21A to 23F) is a hydraulic actuator driven as oil is supplied thereto from the pumps (11 and 12). Each of the actuators (21A to 23F) is a hydraulic motor or a hydraulic cylinder. When the construction machine 1 is a hydraulic excavator, the uses of the actuators (21A to 23F) include running, turning, bucket rotation, arm elevation, and boom elevation. The actuators (21A to 23F) are formed of first actuators (21A and 21D), second actuators (22B and 22C), and third actuators (23E and 23F).

The first actuators (21A and 21D) are driven as oil is supplied thereto from the first pump 11. No oil is supplied to the first actuators (21A and 21D) from the second pump 12. The first actuators (21A and 21D) are formed of a right running motor 21A (one running motor) and a turning motor 21D.

The right running motor 21A (one running motor) is a hydraulic motor for causing the construction machine 1 to run. The right running motor 21A is a hydraulic motor for driving a right crawler of a lower running body of the construction machine 1.

The turning motor 21D is a hydraulic motor for causing an upper turning body to turn relative to the lower running body.

The second actuators (22B and 22C) are driven as oil is supplied thereto from the second pump 12. No oil is supplied to the second actuators (22B and 22C) from the first pump 11. The second actuators (22B and 22C) are formed of a left running motor 22B (the other running motor) and a bucket cylinder 22C.

The left running motor 22B (the other running motor) is a hydraulic motor for causing the construction machine 1 to run. The left running motor 22B is a motor for driving a left crawler of the lower running body of the construction machine 1. Alternatively, the right running motor 21A may be a second actuator and the left running motor 22B may be a first actuator.

The bucket cylinder 22C is a hydraulic cylinder for rotating a bucket relative to an arm.

The third actuators (23E and 23F) can receive oil from both the first pump 11 and the second pump 12. The third actuators (23E and 23F) are driven as oil is supplied thereto from at least one of the first pump 11 and the second pump 12. The third actuators (23E and 23F) are formed of a boom cylinder 23E and an arm cylinder 23F.

The arm cylinder 23F is a cylinder for elevating (moving up, moving down, and rotating) the arm relative to the boom.

The boom cylinder 23E is a cylinder for elevating (moving up, moving down, and rotating) the boom relative to the upper turning body. Note that, when the boom is moved down (boom down), the boom cylinder 23E operates in the same manner as the second actuator (described later). The construction machine 1 may further include an actuator (e.g., "for dozer" shown in FIG. 5) other than the above-described actuators (21A to 23F).

The hydraulic circuit 30 for construction machinery is a hydraulic circuit for controlling the actuators (21A to 23F). The hydraulic circuit 30 for construction machinery is connected with the first pump 11, the second pump 12, the tank 15, and the actuators (21A to 23F). The term "connection" encompasses both direct connection and indirect connection (e.g., via a passage). The same applies to the descriptions hereinbelow. The hydraulic circuit 30 for construction machinery is integrally constructed and is, for example, block-shaped (substantially rectangular parallelepiped in shape). The hydraulic circuit 30 for construction machinery is provided with direction switching valves (51A, 52B, 52C, 51D, 53E, and 53F) (hereinafter, direction switching valves (51A to 53F)) as described later. The hydraulic circuit 30, however, may be referred to as a direction switching valve as a whole. The hydraulic circuit 30 for construction machinery is provided with paths (31 to 43), the direction switching valves (51A to 53F), a pressure detection unit 61, and throttles (71 and 72).

The paths (31 to 43) are oil paths (oil passages or pipes). The paths (31 to 43) include unloading passages (31 and 32), a tank passage 35, and supply passages (41, 42, and 43).

The unloading passages (31 and 32) are paths (bypass passages) for returning oil ejected from the pumps (11 and 12) to the tank 15 without the intervention of the actuators (21A to 23F). However, when oil flows from the unloading passages (31 and 32) to junction passages (a first arm junction passage 41Fa and a second arm junction passage 42Fa which will be described later), oil ejected from the pumps (11 and 12) passes the actuators (21A to 23F). The number of the unloading passages (31 and 32) is two. (In other words, the hydraulic circuit 30 for construction machinery is of a dual-bypass type.) The unloading passages (31 and 32) include a first unloading passage 31 and a second unloading passage 32. The first unloading passage 31 is connected with the first pump 11. The second unloading passage 32 is connected with the second pump 12.

The tank passage 35 is a passage for returning oil to the tank 15. The tank passage 35 is connected with the tank 15, the first unloading passage 31, and the second unloading passage 32. The tank passage 35 is connected with the direction switching valves (51A to 53F). The tank passage 35 is connected with the most downstream parts of the first unloading passage 31 and the second unloading passage 32. The most downstream part is a part which is on the downstream of the direction switching valve (the arm direction switching valve 53F in FIG. 1) which is on the most downstream side (farthest from the pumps (11 and 12)) among the direction switching valves (51A to 53F).

The supply passages (41, 42, and 43) are paths for supplying oil from the pumps (11 and 12) to the actuators (21A to 23F). The supply passages (41, 42, and 43) are formed of a first supply passage 41, a second supply passage 42, and a third supply passage 43.

The first supply passage 41 is a path for supplying oil ejected from the first pump 11 to the first actuators (21A and 21D) and the third actuators (23E and 23F). (The third supply passage 43, however, is not included in the first supply passage 41.) The first supply passage 41 is connected with the first pump 11. The first supply passage 41 is connected with the first unloading passage 31. The first supply passage 41 is connected with the most upstream part of the first unloading passage 31. A position where the first supply passage 41 is connected with the first unloading passage 31 (i.e., a position where the first supply passage 41 and the first unloading passage 31 are branched) is assumed as a connection position 41-1. The connection position is a position for connection in a circuit, and does not indicate a physical position (arrangement). (The same applies hereinafter.) The recitation "the most upstream part of the first unloading passage 31" indicates a part which is on the upstream side (first pump 11 side) of the direction switching valve (the right running direction switching valve 51A (one running direction switching valve) in FIG. 1) which is on the most upstream side among the direction switching valves (51A to 53F) (described later) through which the first unloading passage 31 passes. The first supply passage 41 is provided with a first supply main line passage 41α, first supply branched passages (41A, 41D, 41E, and 41F), and the first arm junction passage 41Fa (first junction passage).

The first supply main line passage 41α is a path capable of supplying oil to two or more of the first direction switching valves (51A and 51D) and the third direction switching valves (53E and 53F). The first supply main line passage 41α has a part capable of supplying oil to the arm direction switching valve 53F and the turning direction switching valve 51D (more specifically, apart on the upstream of a branching point from the first supply main line passage 41α to a turning branched passage 41D).

The first supply branched passages (41A, 41D, 41E, and 41F) are paths capable of supplying oil to only one direction switching valve (51A, 51D, 53E, or 53F) among the first direction switching valves (51A and 51D) and the third direction switching valves (53E and 53F). The first supply branched passages (41A, 41D, 41E, and 41F) are connected with the first supply main line passage 41α. The first supply branched passages (41A, 41D, 41E, and 41F) are formed of a right running branched passage 41A (one running branched passage), a turning branched passage 41D, a first boom branched passage 41E, and a first arm branched passage 41F. The first boom branched passage 41E connects the first supply main line passage 41α with a boom supply passage 43E (described later). The first arm branched passage 41F connects the first supply main line passage 41α with an arm supply passage 43F (described later).

The first arm junction passage 41Fa (first junction passage) is a path for supplying oil (redundant oil) flowing in the first unloading passage 31 to the arm supply passage 43F (third supply passage 43) (i.e., causing the redundant oil to join the arm supply passage 43F). The first arm junction passage 41Fa is connected with the first unloading passage 31 and the arm supply passage 43F (third supply passage 43). The first arm junction passage 41Fa is provided with a connection position 41Fa-1 and a connection position 41Fa-2.

The connection position 41Fa-1 is a connection position where the first arm junction passage 41Fa is connected with the first unloading passage 31 (of the first supply passage 41). The connection position 41Fa-1 is provided between the arm direction switching valve 53F and "another direction switching valve". The recitation "between" above indicates an "in-between passage". The "another direction switching valve" indicates a direction switching valve on the upstream (on the first unloading passage 31) of the arm direction switching valve 53F. To be more specific, the connection position 41Fa-1 is between the turning direction switching valve 51D and the boom direction switching valve 53E.

The connection position 41Fa-2 is a connection position where the first arm junction passage 41Fa is connected with the arm supply passage 43F. The first arm junction passage 41Fa may be connected with the arm supply passage 43F via the first arm branched passage 41F and a second arm branched passage 42F. The connection position 41Fa-2 is provided between a first throttle 71 (described later) and the arm direction switching valve 53F (i.e., on the downstream of the first throttle 71 and on the upstream of the arm direction switching valve 53F). The connection position 41Fa-2 is provided between a second throttle 72 (described later) and the arm direction switching valve 53F (i.e., on the downstream of the second throttle 72 and on the upstream of the arm direction switching valve 53F) The connection position 41Fa-2 is on the arm direction switching valve 53F side (i.e., downstream side) of a check valve provided on the first arm branched passage 41F and a check valve provided on the second arm branched passage 42F.

The second supply passage 42 is a path for supplying oil ejected from the second pump 12 to the second actuators (22B and 22C) and the third actuators (23E and 23F). (The third supply passage 43, however, is not included in the second supply passage 42.) The second supply passage 42 is connected with the second pump 12. The second supply passage 42 is connected with the second unloading passage 32. The second supply passage 42 is connected with the most upstream part of the second unloading passage 32. A connection position where the second supply passage 42 is connected with the second unloading passage 32 (i.e., a position where the second supply passage 42 and the second unloading passage 32 are branched) is assumed as a connection position 42-1. The recitation "the most upstream part of the second unloading passage 32" above indicates a part which is on the upstream side (second pump 12 side) of the most upstream direction switching valve (the left running direction switching valve 52B (the other running direction switching valve) in FIG. 1) among direction switching valves (52B to 53F) (described later) through which the second unloading passage 32 passes. The second supply passage 42 is provided with a second supply main line passage 42α, second supply branched passages (42B, 42C, 42E, and 42F), and the second arm junction passage 42Fa (second junction passage).

The second supply main line passage 42α is a path capable of supplying oil to two or more direction switching valves among the second direction switching valves (52B and 52C) and the third direction switching valves (51E and 53F). The second supply main line passage 42α has a part capable of supplying oil to the boom direction switching valve 53E and the arm direction switching valve 53F (more specifically, a part on the upstream of a branching point from the second supply main line passage 42α to a second boom branched passage 42E).

The second supply branched passages (42B, 42C, 42E, and 42F) are paths capable of supplying oil to only one direction switching valve (52B, 52C, 53E, or 53F) among the second direction switching valves (52B and 52C) and the third direction switching valves (53E and 53F). The second supply branched passages (42B, 42C, 42E, and 42F) are connected with the second supply main line passage 42α. The second supply branched passages (42B, 42C, 42E, and 42F) are formed of a left running branched passage 42B (the other running branched passage), a bucket branched passage 42C, a second boom branched passage 42E, a boom-down branched passage 42E1, and a second arm branched passage 42F. The second boom branched passage 42E connects the second supply main line passage 42α with the boom supply passage 43E (described later). The boom-down branched passage 42E1 may be included in the second boom branched passage 42E (see Second Embodiment below). The second arm branched passage 42F connects the second supply main line passage 42α with an arm supply passage 43F (described later).

The second arm junction passage 42Fa (second junction passage) is a path for supplying oil (redundant oil) flowing in the second unloading passage 32 to the arm supply passage 43F (third supply passage 43) (i.e., causing the redundant oil to join the arm supply passage 43F). The second arm junction passage 42Fa is connected with the second unloading passage 32 and the arm supply passage 43F (third supply passage 43). The second arm junction passage 42Fa is provided with a connection position 42Fa-1 and a connection position 42Fa-2.

The connection position 42Fa-1 is a connection position where the second arm junction passage 42Fa is connected with the second unloading passage 32 (of the second supply passage 42). The connection position 42Fa-1 is provided between the arm direction switching valve 53F and "another direction switching valve". The "another direction switching valve" indicates a direction switching valve on the upstream (on the second unloading passage 32) of the arm direction switching valve 53F. To be more specific, the connection position 42Fa-1 is between the boom direction switching valve 53E and the arm direction switching valve 53F.

The connection position 42Fa-2 is a connection position where the second arm junction passage 42Fa is connected with the arm supply passage 43F. The second arm junction passage 42Fa may be connected with the arm supply passage 43F via the first arm branched passage 41F and a second arm branched passage 42F. The connection position 42Fa-2 is provided between the first throttle 71 (described later) and the arm direction switching valve 53F. The connection position 42Fa-2 is on the downstream of the first throttle 71 and is on the upstream of the arm direction switching valve 53F. The connection position 42Fa-2 is provided between the second throttle 72 (described later) and the arm direction switching valve 53F. The connection position 42Fa-2 is on the downstream of the second throttle 72 and on the upstream of the arm direction switching valve 53F. The connection position 42Fa-2 is on the arm direction switching valve 53F side (downstream side) of a check valve provided on the first arm branched passage 41F and a check valve provided on the second arm branched passage 42F.

The third supply passage 43 is a path for supplying oil ejected from the first pump 11 and the second pump 12 to the third actuators (23E and 23F). The third supply passage 43 is connected with the first supply passage 41 and the second supply passage 42. In the third supply passage 43, oil after the oil flowing in the first supply passage 41 and the oil flowing in the second supply passage 42 are joined flows. The third supply passage 43 is formed of the boom supply passage 43E and the arm supply passage 43F.

The boom supply passage 43E is connected with the boom direction switching valve 53E (described later). The boom supply passage 43E is connected with the first boom branched passage 41E and the second boom branched passage 42E.

The arm supply passage 43F is connected with the arm direction switching valve 53F (described later). The arm supply passage 43F is connected with the first arm branched passage 41F and the second arm branched passage 42F.

On the paths (31 to 43), check valves are provided. Each check valve prevents backward flow of oil from the direction switching valves (52C, 51D, 53E, and 53F) to the supply passages (41 and 42) and the unloading passages (31 and 32). Check valves are provided, for example, on first supply branched passages (the turning branched passage 41D, the first boom branched passage 41E, and the first arm branched passage 41F). Check valves are provided, for example, on second supply branched passages (the bucket branched passage 42C, the second boom branched passage 42E, the boom-down branched passage 42E1, and the second arm branched passage 42F). Check valves are provided, for example, on the first arm junction passage 41Fa and a second arm junction passage 42Fb.

The direction switching valves (51A to 53F) change the flow rate and direction of oil supplied from the pumps (11 and 12) to the actuators (21A to 23F) (i.e., adjust the flow rate and switch the direction). The direction switching valves (51A to 53F) are valves to supply and discharge oil to and from the actuators (21A to 23F). The direction switching valves (51A to 53F) supply oil ejected from the pumps (11 and 12) to the actuators (21A to 23F). The direction switching valves (51A to 53F) discharge (return) oil ejected from the actuators (21A to 23F) to the tank 15. The direction switching valves (51A to 53F) are provided between the pumps (11 and 12) and the actuators (21A to 23F). Each of the direction switching valves (51A to 53F) is a spool valve. A spool valve changes the flow rate and direction of oil in accordance with the stroke amount (position) of a spool.

The direction switching valves (51A to 53F) switch the connection between passages (parts of the paths (31 to 43)) connected with the direction switching valves (51A to 53F) and the opening degree (valve opening degree) of the connection, in accordance with the stroke amount of the spool. To be more specific, each of the direction switching valves (51A to 53F) sets a passage at a "cutoff state" or a "connection state". The cutoff state is a state in which passages are not connected with each other (i.e., passage are cut off).

The connection state is a state in which passages are connected with each other (communicate with each other). The connection state is further divided into a "full-opened state" and a "throttled state".

The full-opened state is a state in which the valve opening degree is at the maximum. When the valve opening degree is at the maximum, the valve opening degree, which is variously changed as the spool of each of the direction switching valves (51A to 53F) moves from one end to the other end, is at the maximum. For example, in the full-opened state, a passage is not throttled (or rarely throttled).

In the throttled state, a passage is throttled as compared to the full-opened state (but the cutoff state is excluded).

The direction switching valves (51A to 53F) are operated by an operator of the construction machine 1 (by means of a lever operation). In response to a lever operation, the changeover position of each of the direction switching valves (51A to 53F) is switched. The changeover position of the direction switching valves (51A to 53F) is either a neutral position or an operating position.

(Neutral Position) The neutral position is the changeover position when the lever is not operated (e.g., when a lever operation amount is zero). When the changeover position is at the neutral position, the direction switching valves (51A to 53F) do not supply or discharge oil to or from the actuators (21A to 23F).

(Operating Position) The operating position is the changeover position when the lever is being operated (e.g., when the lever operation amount is not zero). When the changeover position is at the operating position, the direction switching valves (51A to 53F) supply and discharge oil to and from the actuators (21A to 23F). When the changeover position is at the operating position, the direction switching valves (51A to 53F) change an amount of oil supplied and discharged to and from the actuators (21A to 23F) in accordance with the lever operation amount.

The direction switching valves (51A to 53F) are constituted by the first direction switching valves (51A and 51D), the second direction switching valves (52B and 52C), and the third direction switching valves (53E and 53F). From the upstream to the downstream on the unloading passages (31 and 32), the direction switching valves (51A to 53F) include a right running direction switching valve 51A, a left running direction switching valve 52B, a bucket direction switching valve 52C, the turning direction switching valve 51D, the boom direction switching valve 53E, and the arm direction switching valve 53F.

The first direction switching valves (51A and 51D) are valves for changing the flow rate and direction of oil flowing from the first pump 11 to the first actuators (21A and 21D). The first direction switching valves (51A and 51D) supply and discharge oil to and from the first actuators (21A and 21D). The first direction switching valves (51A and 51D) are connected with the first supply passage 41, the first unloading passage 31, and the tank passage 35. The first direction switching valves (51A and 51D) may be connected with the second unloading passage 32 (see the turning direction switching valve 51D) or may not be connected with the second unloading passage 32 (see the right running direction switching valve 51A).

The first direction switching valves (51A and 51D) operate as below.

(Neutral Position) When the changeover position is at the neutral position, the first direction switching valves (51A and 51D) do not supply and discharge oil to and from the first actuators (21A and 21D). To be more specific, when the changeover position is at the neutral position, the first direction switching valves (51A and 51D) set the first unloading passage 31 at the full-opened state and set the first supply passage 41 and the tank passage 35 at the cutoff state.

(Operating Position) When the changeover position is at the operating position, the first direction switching valves (51A and 51D) supply and discharge oil to and from the first actuators (21A and 21D). To be more specific, when the changeover position is at the operating position, the first direction switching valves (51A and 51D) set the first unloading passage 31 at either the cutoff state or the throttled state. When the changeover position is at the operating position, the first direction switching valves (51A and 51D) set the first supply passage 41 and the tank passage 35 at the connection state (full-opened state or throttled state). As a result, the oil ejected from the first pump 11 flows in the first supply passage 41, the oil flowing in the first supply passage 41 is supplied to the first actuators (21A and 21D), and the oil ejected from the first actuators (21A and 21D) flows in the tank passage 35.

(Neutral Position and Operating Position) Irrespective of the changeover position, the first direction switching valve (turning direction switching valve 51D) connected with the second unloading passage 32 maintains the second unloading passage 32 at the full-opened state.

The first direction switching valves (51A and 51D) is formed of the right running direction switching valve 51A and the turning direction switching valve 51D.

The right running direction switching valve 51A (one running direction switching valve) supplies and discharges oil to and from the right running motor 21A. The right running direction switching valve 51A is connected with the right running branched passage 41A.

The turning direction switching valve 51D supplies and discharges oil to and from the turning motor 21D. The turning direction switching valve 51D is connected with the turning branched passage 41D.

The second direction switching valves (52B and 52C) are valves for changing the flow rate and direction of oil flowing from the second pump 12 to the second actuators (22B and 22C). The second direction switching valves (52B and 52C) supply and discharge oil to and from the second actuators (22B and 22C). The second direction switching valves (52B and 52C) are connected with the second supply passage 42, the second unloading passage 32, and the tank passage 35. The second direction switching valves (52B and 52C) are connected with the first unloading passage 31. The second direction switching valves (523 and 52C) may not be connected with the first unloading passage 31 (not illustrated).

The second direction switching valves (523 and 52C) operate as below.

(Neutral Position) When the changeover position is at the neutral position, the second direction switching valves (52B and 52C) do not supply and discharge oil to and from the second actuators (22B and 22C). To be more specific, when the changeover position is at the neutral position, the second direction switching valves (52B and 52C) set the second unloading passage 32 at the full-opened state and set the second supply passage 42 and the tank passage 35 at the cutoff state.

(Operating Position) When the changeover position is at the operating position, the second direction switching valves (52B and 52C) supply and discharge oil to and from the second actuators (22B and 22C). To be more specific, when the changeover position is at the operating position, the second direction switching valves (52B and 52C) set the second unloading passage 32 at either the cutoff state or the throttled state. When the changeover position is at the operating position, the second direction switching valves (52B and 52C) set the second supply passage 42 and the tank passage 35 at the connection state (full-opened state or throttled state). As a result, the oil ejected from the second pump 12 flows in the second supply passage 42, the oil flowing in the second supply passage 42 is supplied to the second actuators (22B and 22C), and the oil ejected from the second actuators (22B and 22C) flows in the tank passage 35.

(Neutral Position and Operating Position) Irrespective of the changeover position, the second direction switching valves (52B and 52C) connected with the first unloading passage 31 maintain the first unloading passage 31 at the full-opened state.

The second direction switching valves (52B and 52C) is formed of the left running direction switching valve 52B and the bucket direction switching valve 52C.

The left running direction switching valve 52B (the other running direction switching valve) supplies and discharges oil to and from the left running motor 22B. The left running direction switching valve 52B is connected with the left running branched passage 42B.

The bucket direction switching valve 52C supplies and discharges oil to and from the bucket cylinder 22C. The bucket direction switching valve 52C is connected with the bucket branched passage 42C.

The third direction switching valves (53E and 53F) are valves for changing the flow rate and direction of oil flowing from the first pump 11 and the second pump 12 to the third actuators (23E and 23F). The third direction switching valves (53E and 53F) supply and discharge oil to and from the third actuators (23E and 23F). The third direction switching valves (53E and 53F) are connected with the third supply passage 43, the first unloading passage 31, the second unloading passage 32, and the tank passage 35. The third direction switching valves (53E and 53F) are provided on the downstream (i.e., on the downstream in the unloading passages (31 and 32)) of the first direction switching valves (51A and 51D) and the second direction switching valves (52B and 52C). The third direction switching valves (53E and 53F) may operate in a manner similar to the second direction switching valves (52B and 52C) at one or more changeover position (see the boom down position 53Ec of the boom direction switching valve 53E and FIG. 2). How the third direction switching valves (53E and 53F) operate will be described later. The third direction switching valves (53E and 53F) are formed of the boom direction switching valve 53E and the arm direction switching valve 53F.

Figure 2:
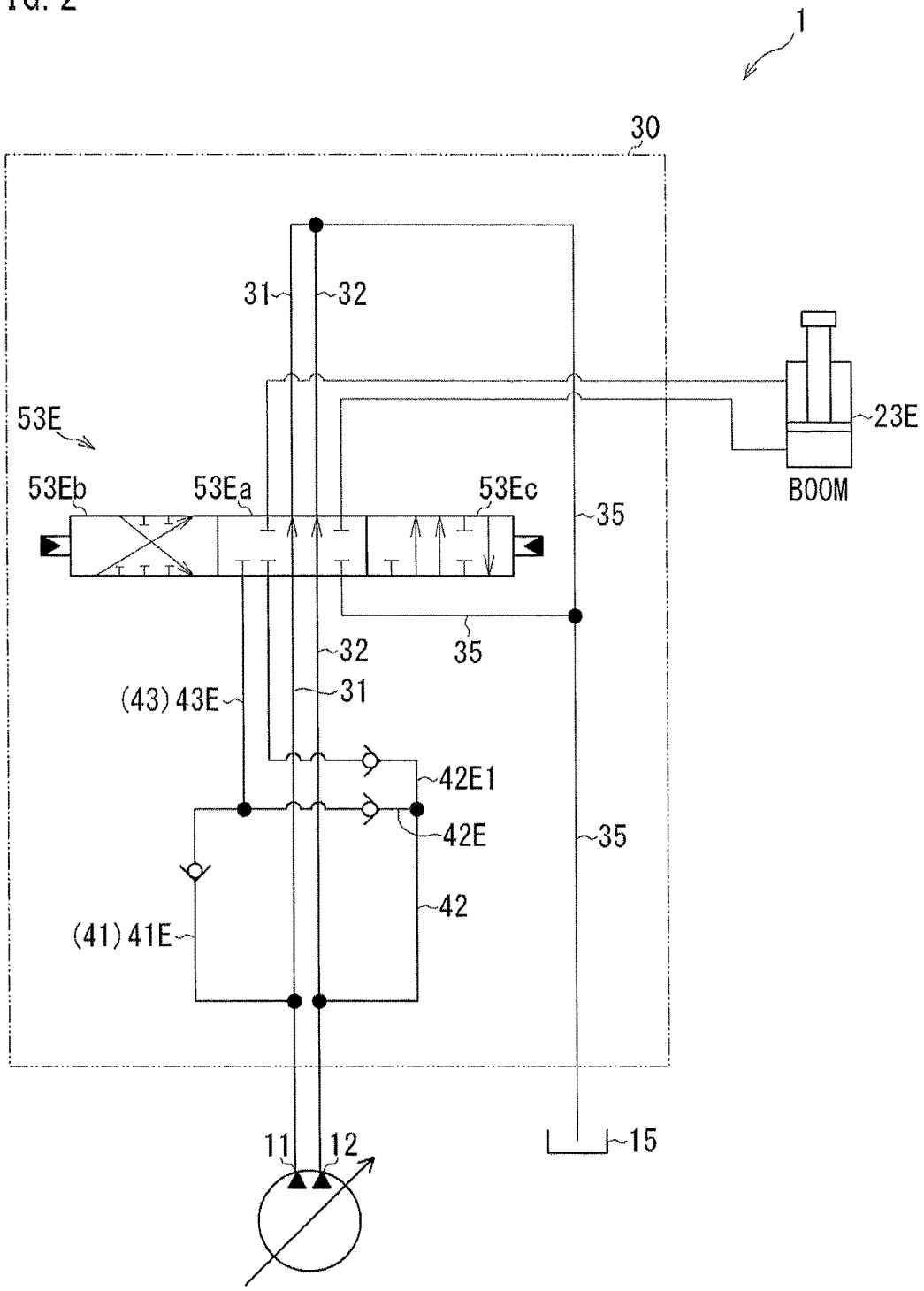
FIG. 2 is a hydraulic circuit diagram of a boom direction switching valve 53E and the like shown in FIG. 1.

The boom direction switching valve 53E supplies and discharges oil to and from the boom cylinder 23E. The boom direction switching valve 53E is provided on the downstream of another direction switching valve (which is on the upstream of the boom direction switching valve 53E on the unloading passages (31 and 32)). To be more specific, the boom direction switching valve 53E is on the downstream of the turning direction switching valve 51D. As shown in FIG. 2, the boom direction switching valve 53E is connected with the boom supply passage 43E. The boom direction switching valve 53E is connected with the boom-down branched passage 42E1. The changeover position of the boom direction switching valve 53E is a neutral position 53Ea or one of operating positions (53Eb and 53Ec). The operating positions (53Eb and 53Ec) are formed of a boom up position 53Eb and the boom down position 53Ec. The boom up position 53Eb is the changeover position selected when moving up the boom. The boom down position 53Ec is the changeover position selected when moving down the boom.

Figure 3:
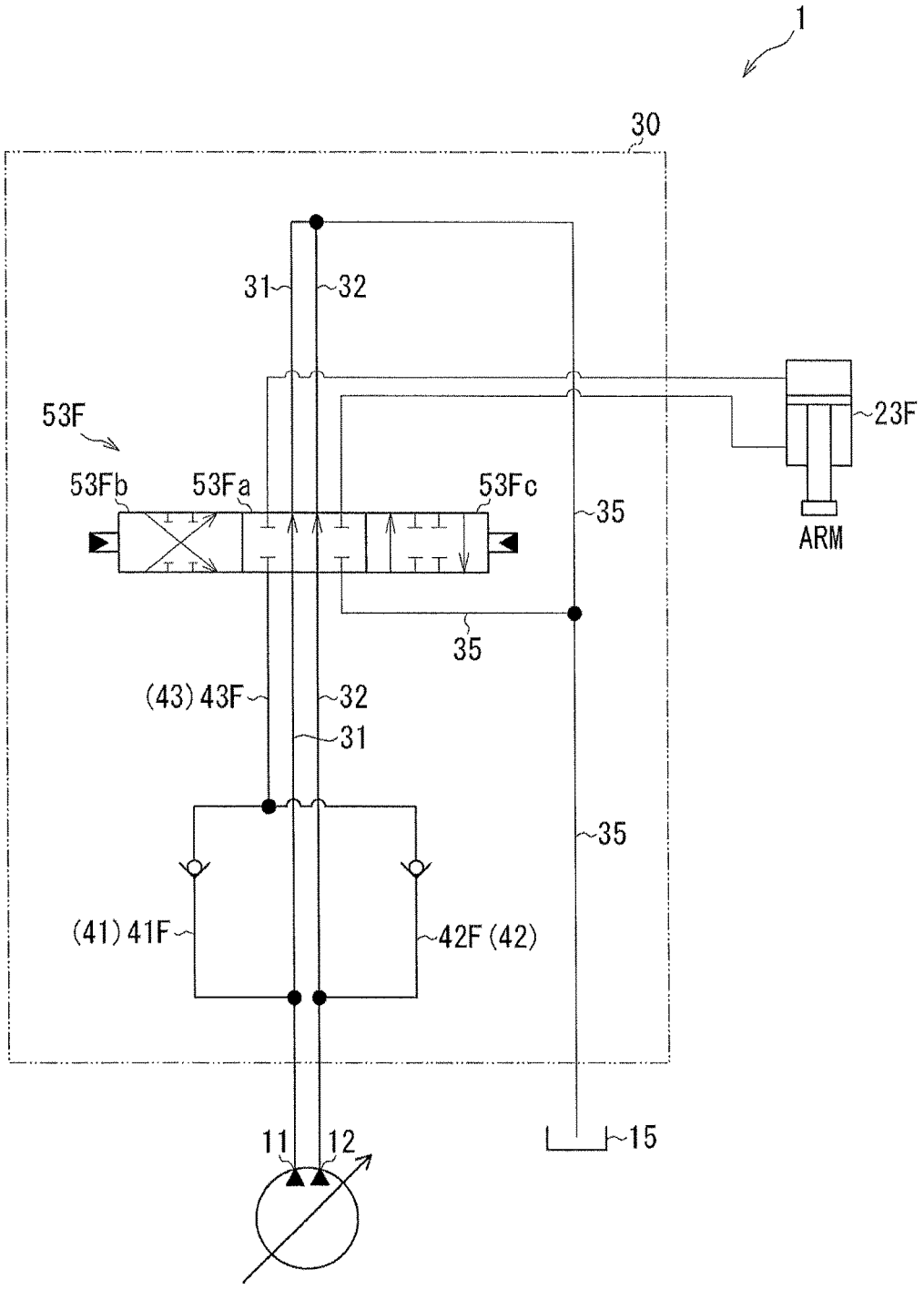
FIG. 3 is a hydraulic circuit diagram of an arm direction switching valve 53F and the like shown in FIG. 1.

As shown in FIG. 1, the arm direction switching valve 53F supplies and discharges oil to and from the arm cylinder 23F. The arm direction switching valve 53F is provided on the downstream of another direction switching valve (i.e., a direction switching valve on the upstream of the arm direction switching valve 53F on the unloading passages (31 and 32)). To be more specific, the arm direction switching valve 53F is on the downstream of the boom direction switching valve 53E. As shown in FIG. 3, the arm direction switching valve 53F is connected with the arm supply passage 43F. The changeover position of the arm direction switching valve 53F is a neutral position 53Fa or operating positions (53Fb and 53Fc).

The pressure detection unit 61 is provided to control (i.e., to perform negative control) of the capacities of the pumps (11 and 12) shown in FIG. 1. The pressure detection unit 61 detects the pressure (negative-controlled pressure) at the most downstream parts of the unloading passages (31 and 32). The pressure detection unit 61 detects lower one of the pressures of the first unloading passage 31 and the second unloading passage 32. In accordance with the pressure detected by the pressure detection unit 61, the ejection amounts of the pumps (11 and 12) are adjusted. To be more specific, the more the amount of oil flowing from the pumps (11 and 12) to the actuators (21A to 23F) (i.e., the oil used by the actuators) is, the less the amount of oil flowing in the unloading passages (31 and 32) is, with the result that the pressure detected by the pressure detection unit 61 becomes low. For this reason, the capacities of the pumps (11 and 12) are controlled (i.e., the tilt angle is changed) so that the ejection amounts of the pumps (11 and 12) increase as the pressure detected by the pressure detection unit 61 decreases. The hydraulic circuit 30 for construction machinery may be arranged so that the capacities of the pumps (11 and 12) are controlled based on positive control. In the hydraulic circuit 30 for construction machinery, the capacities of the pumps (11 and 12) may not be controlled.

The throttles (71 and 72) are provided on the first supply passage 41 and the second supply passage 42, respectively. The throttles (71 and 72) are provided to adjust the amounts of oil flowing from the first supply passage 41 and the second supply passage 42 into the third supply passage 43. The throttles (71 and 72) are formed of the first throttle 71 and the second throttle 72.

The first throttle 71 is provided on the first arm branched passage 41F. The first throttle 71 is provided to prevent the decrease in the pressure of the first supply passage 41. The first throttle 71 is provided to secure sufficient torque at the start of the turning of the turning motor 21D (i.e., at the start of the turning from the stopped state) by securing sufficient hydraulic pressure supplied to the turning direction switching valve 51D. When the first throttle 71 is provided, the oil supplied to the arm direction switching valve 53F through the first throttle 71 is reduced in amount. However, when oil is supplied from the first arm junction passage 41Fa to the arm direction switching valve 53F, the operation of the arm cylinder 23F is facilitated because oil supplied to the arm direction switching valve 53F passes not only the first throttle 71 but also the first arm junction passage 41Fa.

The second throttle 72 is provided on the second arm branched passage 42F. The second throttle 72 is provided to supply oil preferentially to the boom direction switching valve 53E (as compared to the arm direction switching valve 53F) from the second supply passage 42. When the second throttle 72 is provided, the oil supplied to the arm direction switching valve 53F through the second throttle 72 is reduced in amount. However, when oil is supplied from the second arm junction passage 42Fa to the arm direction switching valve 53F, the operation of the arm cylinder 23F is facilitated because oil supplied to the arm direction switching valve 53F passes not only the second throttle 72 but also the second arm junction passage 42Fa.

(Operation of Third Direction Switching Valves (53E and 53F))

The outline of the operation of the third direction switching valves (53E and 53F) shown in FIG. 1 is as below (except the boom down position 53Ec). The third direction switching valves (53E and 53F) adjust the opening degrees of the first unloading passage 31 and the second unloading passage 32 in accordance with a lever operation (i.e., an operation of the third direction switching valves (53E and 53F)). By this adjustment of the opening degrees, the third direction switching valves (53E and 53F) adjust the flow rate of the oil flowing into the third supply passage 43 from the first supply passage 41 and the second supply passage 42. By the adjustment of the opening degrees, the third direction switching valves (53E and 53F) adjust the flow rate of oil supplied to and discharged from the third actuators (23E and 23F).

(Operation of Arm Direction Switching Valve 53F)

The following will describe the operation of the arm direction switching valve 53F with reference to FIG. 3.

(Neutral Position 53Fa) When the changeover position is at the neutral position 53Fa, the arm direction switching valve 53F does not supply and discharge oil to and from the arm cylinder 23F. To be more specific, at the neutral position 53Fa, the first unloading passage 31 and the second unloading passage 32 are in the full-opened state whereas the third supply passage 43 and the tank passage 35 are in the cutoff state.

(Operating Positions (53Fb and 53Fc)) When the changeover position is at one of the operating positions (53Fb and 53Fc), the arm direction switching valve 53F supplies and discharges oil to and from the arm cylinder 23F. To be more specific, at the operating positions (53Fb and 53Fc), the first unloading passage 31 and the second unloading passage 32 are in the cutoff state or the throttled state (as detailed later). Furthermore, at the operating positions (53Fb and 53Fc), the third supply passage 43 and the tank passage 35 are in the connection state (the full-opened state or the throttled state). As a result, the oil flowing in the first supply passage 41 and the oil flowing in the second supply passage 42 are joined with the third supply passage 43. (An exception will be described later). Then the oil flowing in the third supply passage 43 is supplied to the arm cylinder 23F and the oil ejected from the arm cylinder 23F flows into the tank passage 35.

(Operation of Boom Direction Switching Valve 53E)

The following will describe the operation of the boom direction switching valve 53E with reference to FIG. 2.

(Neutral Position) When the changeover position is at the neutral position 53Ea, the boom direction switching valve 53E does not supply and discharge oil to and from the boom cylinder 23E. To be more specific, at the neutral position 53Ea, the first unloading passage 31 and the second unloading passage 32 are in the full-opened state whereas the third supply passage 43 and the tank passage 35 are in the cutoff state.

(Boom Up Position 53Eb) When the changeover position is at the boom up position 53Eb, the boom direction switching valve 53E supplies and discharges oil to and from the boom cylinder 23E. To be more specific, at the boom up position 53Eb, the first unloading passage 31 and the second unloading passage 32 are in the cutoff state or the throttled state (as detailed later). Furthermore, at the boom up position 53Eb, the third supply passage 43 and the tank passage 35 are in the connection state (the full-opened state or the throttled state). As a result, the oil flowing in the first supply passage 41 and the oil flowing in the second supply passage 42 are joined with the third supply passage 43. (An exception will be described later). Then the oil flowing in the third supply passage 43 is supplied to the boom cylinder 23E and the oil ejected from the boom cylinder 23E flows into the tank passage 35. As a result, the boom is moved up.

(Boom Down Position 53Ec) When the boom down position 53Ec is selected, the boom direction switching valve 53E functions in the same manner as the second direction switching valves (52B and 52C). When the changeover position is at the boom down position 53Ec, the boom direction switching valve 53E supplies oil from the second supply passage 42 to the boom cylinder 23E and does not supply oil from the third supply passage 43 (boom supply passage 43E) to the boom cylinder 23E. At the time of boom down, oil is supplied to the boom direction switching valve 53E from only the second supply passage 42 among the first supply passage 41 and the second supply passage 42. To be more specific, at the boom down position 53Ec, the first unloading passage 31 is in the full-opened state (is maintained to be in the full-opened state). At the boom down position 53Ec, the boom supply passage 43E (third supply passage 43) is in the cutoff state. Being similar to the second direction switching valves (52B and 52C), the second unloading passage 32 is in the cutoff state or the throttled state at the boom down position 53Ec. Being similar to the second direction switching valves (523 and 52C), at the boom down position 53Ec, the boom-down branched passage 42E1 (second supply passage 42) and the tank passage 35 are in the connection state (the full-opened state or the throttled state). As a result, the oil ejected from the second pump 12 flows in the boom-down branched passage 42E1 (second supply passage 42), the oil flowing in the boom-down branched passage 42E1 is supplied to the boom cylinder 23E, and the oil ejected from the boom cylinder 23E flows in the tank passage 35. As a result, the boom is moved down.

(Modification of Boom Down) When the boom down position 53Ec is selected, the boom direction switching valve 53E may function in a manner similar to the first direction switching valves (51A and 51D) as a modification. This modification is arranged as follows. The boom-down branched passage 42E1 is connected with not the second supply passage 42 but the first supply passage 41. At the boom down position 53Ec, not the first unloading passage 31 but the second unloading passage 32 is maintained to be in the full-opened state. At the time of boom down, oil is supplied to the boom supply passage 43E from only the first supply passage 41 among the first supply passage 41 and the second supply passage 42.

Figure 4:
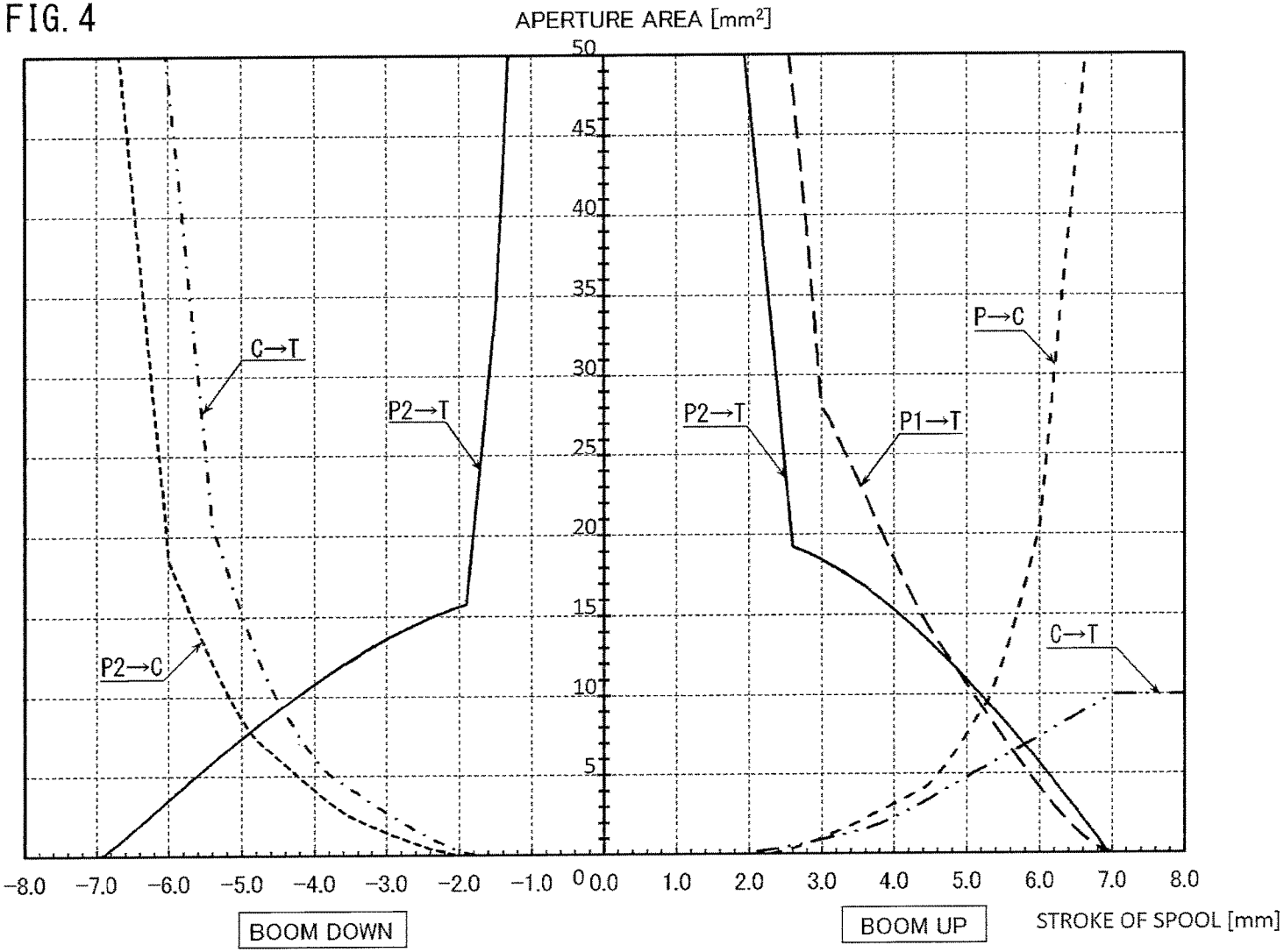
FIG. 4 is a graph showing the relationship between a stroke amount and an aperture area of the boom direction switching valve 53E shown in FIG. 1.

(Difference in Opening Degree) A graph indicating the opening degrees of the respective passages passing the boom direction switching valve 53E is shown in FIG. 4. The horizontal axis of the graph in FIG. 4 indicates a stroke amount of a spool of the boom direction switching valve 53E (see FIG. 2). This stroke amount is in proportion to a lever operation amount. A case where the stroke amount is zero corresponds to the neutral position 53Ea (see FIG. 2). A case where the stroke amount is a positive number corresponds to the boom up position 53Eb (see FIG. 2). A case where the stroke amount is a negative number corresponds to the boom down position 53Ec (see FIG. 2). The vertical axis of the graph indicates the aperture area (=aperture area in full-opened state x opening degree) of each passage passing the boom direction switching valve 53E. In this graph, "P1→T" (indicating the first pump 11 to the tank 15) is added to the graph of the opening degree of the first unloading passage 31 (see FIG. 2). Furthermore, "P2→T" (indicating the second pump 12 to the tank 15) is added to the graph of the opening degree of the second unloading passage 32 (see FIG. 2). Furthermore, "P→C" (indicating the pumps (11 and 12) to the boom cylinder 23E) is added to the graph of the opening degree of the third supply passage 43 (see FIG. 2). Furthermore, "C→T" (indicating the boom cylinder 23E to the tank 15) is added to the graph of the opening degree of the tank passage 35 (see FIG. 2). Furthermore, "P2→C" (indicating the second pump 12 to the boom cylinder 23E) is added to the graph of the opening degree of the boom-down branched passage 42E1 (see FIG. 2).

At the boom up position 53Eb shown in FIG. 2, the opening degree of the first unloading passage 31 (see "P1→T" in FIG. 4) is different from the opening degree of the second unloading passage 32 (see "P2→T" in FIG. 4). (This difference will be referred to as [Difference X]). On account of this [Difference X], the flow rate of the oil flowing from the first supply passage 41 to the third supply passage 43 is different from the flow rate of the second supply passage 42 to the third supply passage 43. Because of this difference in the flow rate, one of the first supply passage 41 and the second supply passage 42 functions as a main supply passage whereas the other one functions as an auxiliary supply passage.

(Region Where Difference X Occur) The [Difference X] occurs when the boom direction switching valve 53E (third direction switching valve) is operated (i.e., the lever operation amount is not zero). The [Difference X] occurs when at least one of the first unloading passage 31 and the second unloading passage 32 is in a region (throttled state) between the cutoff state and the full-opened state. The region between the cutoff state and the full-opened state is a region which is open as compared to the cutoff state and closed as compared to the full-opened state, i.e., a transitional region. In the region, the opening degree is changed in accordance with the lever operation amount. To be more specific, in the graph shown in FIG. 4, the stroke amount falls within the range of about 1.9 to about 7.0 [mm]. [Difference X] is either [Difference Xa] or [Difference Xb] as below.

[Difference Xa] When the lever operation amount is a certain amount, the magnitude of the opening degree of the first unloading passage 31 (see FIG. 2) (i.e., the degree of the throttle) is different from the magnitude of the opening degree of the second unloading passage 32 (see FIG. 2). To be more specific, in the graph shown in FIG. 4, the magnitude of the opening degree of the first unloading passage 31 is different from the magnitude of the opening degree of the second unloading passage 32 when the stroke amount falls within the range of about 1.9 to about 7.0 [mm] (except 4.8 [mm]). The opening degree of the first unloading passage 31 is larger than the opening degree of the second unloading passage 32 when the stroke amount falls within the range of about 1.9 to about 4.7 [mm]. The opening degree of the first unloading passage 31 is smaller than the opening degree of the second unloading passage 32 when the stroke amount falls within the range of about 4.9 to about 7.0 [mm]. This [Difference Xa] encompasses the following [Difference Xa1].

[Difference Xa1] Among the first unloading passage 31 and the second unloading passage 32 shown in FIG. 2, one of them is in the throttled state whereas the other one of them is in the full-opened state. To be more specific, in the graph shown in FIG. 4, the first unloading passage 31 and the second unloading passage 32, which are shown in FIG. 2, are in the full-opened state and in the throttled state, respectively, when the stroke amount falls within the range of about 1.9 to about 2.6 [mm]. As such, when one of the first unloading passage 31 and the second unloading passage 32 is in the throttled state whereas the other one of them is in the full-opened state, oil is supplied to the boom supply passage 43E from only one of the first supply passage 41 and the second supply passage 42. As such, a fine operation is easily done as compared to a case where oil is supplied to the boom supply passage 43E from both the first supply passage 41 and the second supply passage 42. The fine operation indicates that an actuator (the boom cylinder 23E in this case) is operated at a very low operation speed.

[Difference Xb] The magnitude of change (speed of opening, speed of closing, the degree of increase or decrease) in the opening degree of the first unloading passage 31 is different from the degree of change in the opening degree of the second unloading passage 32, while the lever operation amount is changing. To be more specific, in the graph shown in FIG. 4, when the stroke amount falls within the range of about 2.6 to 4.6 [mm], the first unloading passage 31 and the second unloading passage 32, which are shown in FIG. 2, are different from each other in the magnitude of change in the opening degree (i.e., different from each other in the inclination of the graph).

(Difference in Opening Degree: Arm) The [Difference X] indicates the difference between the opening degree of the first unloading passage 31 and the opening degree of the second unloading passage 32 when the boom direction switching valve 53E is at the boom up position 53Eb shown in FIG. 2. Alternatively, when the arm direction switching valve 53F is at the operating positions (53Fb and 53Fc) shown in FIG. 3, the opening degree of the first unloading passage 31 may be arranged to be different from the opening degree of the second unloading passage 32. For example, on the contrary to the [Difference Xa1] above, oil may be supplied to the arm direction switching valve 53F only from the first supply passage 41 among the first supply passage 41 and the second supply passage 42. When the opening degree of the first unloading passage 31 is different from the opening degree of the second unloading passage 32, a fine operation of the arm cylinder 23F is facilitated.

(Effect 1 (Invention 1))

An effect of the hydraulic circuit 30 for construction machinery shown in FIG. 1 will be described. The hydraulic circuit 30 for construction machinery is connected with the first pump 11, the second pump 12, the tank 15, and the actuators (21A to 23F). The hydraulic circuit 30 for construction machinery includes the first unloading passage 31 connected with the first pump 11, the second unloading passage 32 connected with the second pump 12, the first supply passage 41 connected with the first pump 11, and the second supply passage 42 connected with the second pump 12. The hydraulic circuit 30 for construction machinery includes the tank passage 35, the first direction switching valves (51A and 51D), and the second direction switching valves (52B and 52C). The tank passage 35 is connected with the first unloading passage 31, the second unloading passage 32, and the tank 15. The first direction switching valves (51A and 51D) are connected with the first supply passage 41, the first unloading passage 31, and the tank passage 35, and supply and discharge oil to and from the first actuators (21A and 21D). The second direction switching valves (52B and 52C) are connected with the second supply passage 42, the second unloading passage 32, and the tank passage 35, and supply and discharge oil to and from the second actuators (22B and 22C). Furthermore, the hydraulic circuit 30 for construction machinery includes the third supply passage 43 and the third direction switching valves (53E and 53F).

[Configuration 1-1] The third supply passage 43 is connected with the first supply passage 41 and the second supply passage 42.

[Configuration 1-2] The third direction switching valves (53E and 53F) are connected with the third supply passage 43, the first unloading passage 31, the second unloading passage 32, and the tank passage 35, and supply and discharge oil to and from the third actuators (23E and 23F).

Figure 10:
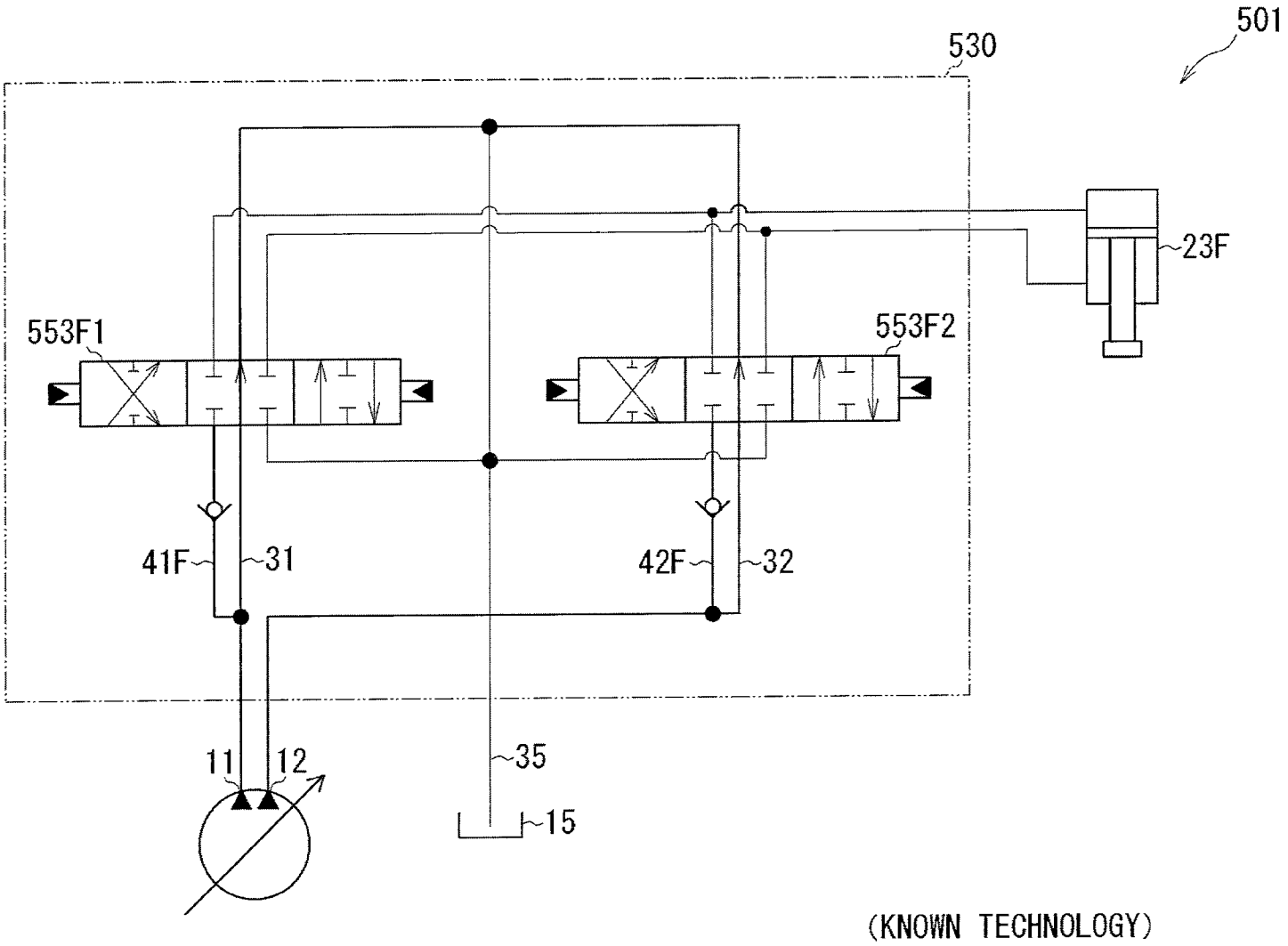
FIG. 10 relates to a known technology and is equivalent to FIG. 3.

On account of the [Configuration 1-1] above, oil ejected from the first pump 11 and the second pump 12 flows into the third supply passage 43. On account of the [Configuration 1-2] above, the third direction switching valve (53E or 53F) supplies the oil ejected from the first pump 11 and the second pump 12 to the third actuator (23E or 23F). With these configurations, supply of oil from the two pumps (11 and 12) to one third actuator (23E or 23F) can be done by one third direction switching valve (53E or 53F). As compared to the known technology, it is therefore possible to reduce the number of the third direction switching valve (53E or 53F) by one for one third actuator (23E or 23F). It is therefore possible to reduce the cost for the third direction switching valve (53E or 53F) while oil is supplied from two pumps (11 and 12) to one third actuator (23E or 23F). The "known technology" above is, as shown in FIG. 10, supply of oil from two pumps (11 and 12) to one actuator (23F) is done by two direction switching valves (553F1 and 553F2).

Figure 5:
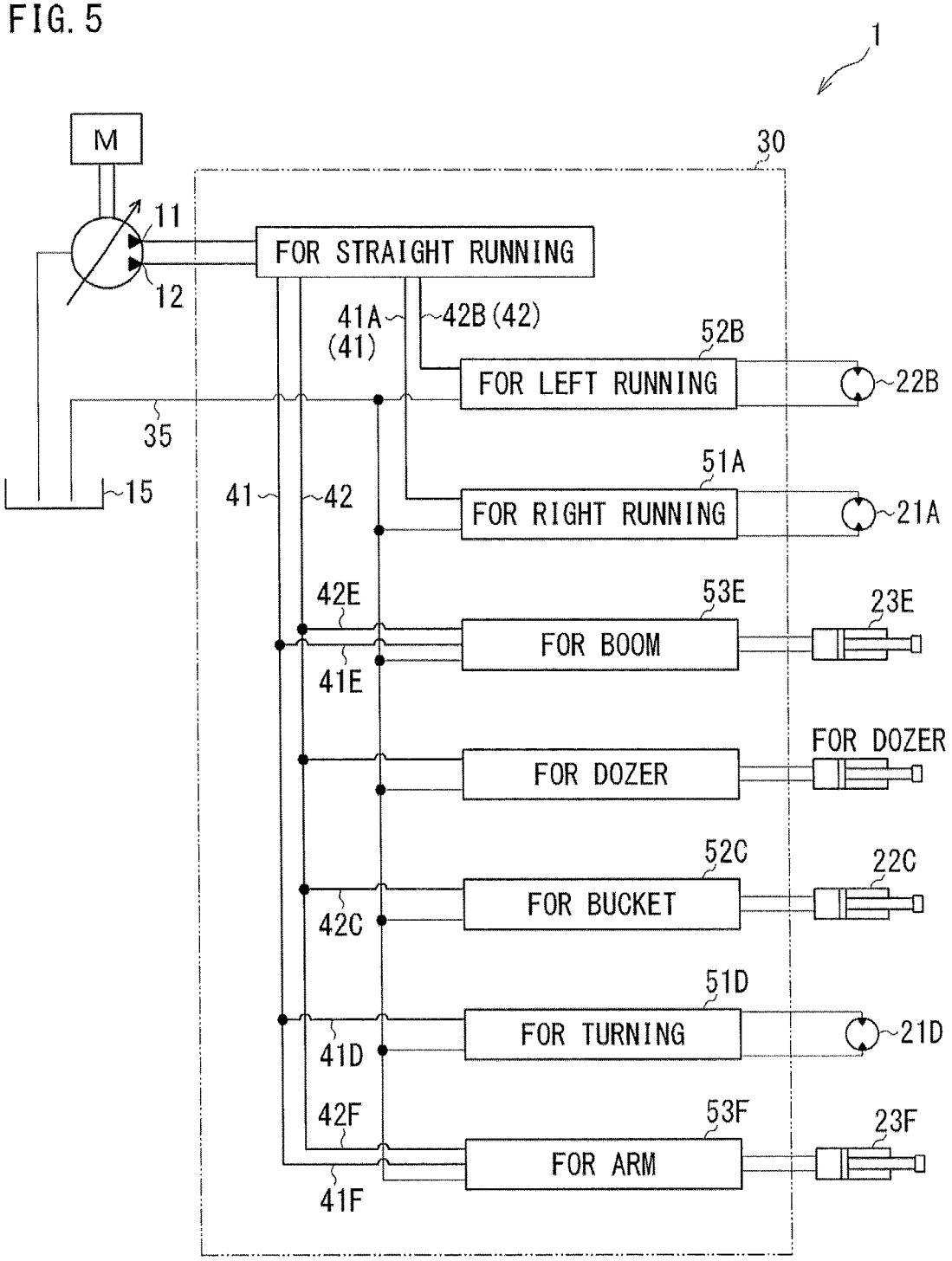
FIG. 5 is a schematic view showing the hydraulic circuit of the construction machine 1 shown in FIG. 1.
Figure 11:
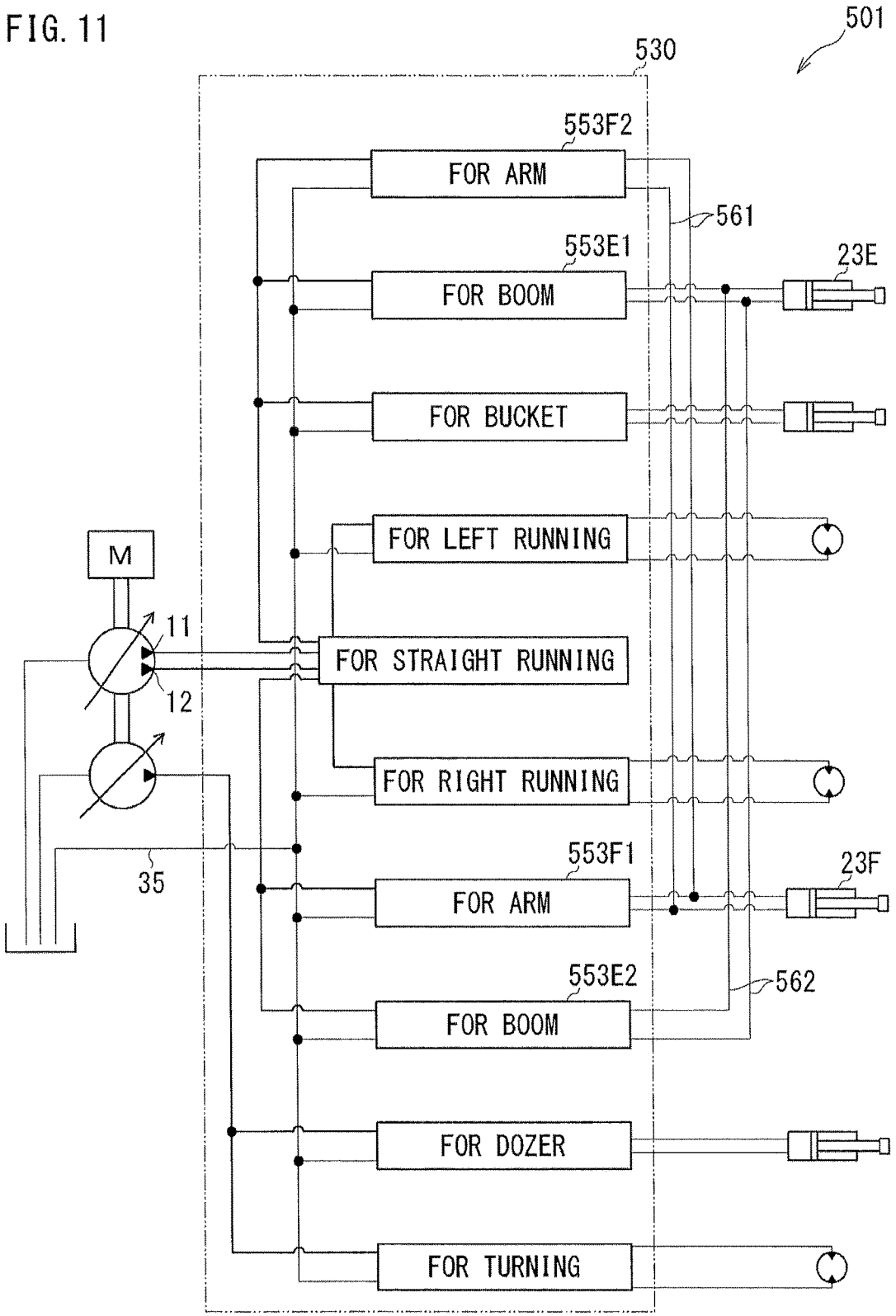
FIG. 11 relates to a known technology and is equivalent to FIG. 5.

A specific example of this effect is as follows. FIG. 5 is a schematic view showing the hydraulic circuit 30 of the construction machine 1 of the present embodiment. FIG. 5 shows a direction switching valve and an actuator for "dozer" and a direction switching valve for "straight running", which are not shown in FIG. 1. An example of a known technology is shown in FIG. 10 and FIG. 11. As shown in FIG. 11, a known construction machine 501 is provided with three pumps and plural direction switching valves each of which is an open-center type (i.e., the number of unloading passages is one). This construction machine 501 is provided with an arm cylinder 23F to which oil is supplied from two pumps (11 and 12) and a boom cylinder 23E to which oil is supplied from the two pumps (11 and 12). In the known hydraulic circuit 530 for construction machinery, the number of the arm direction switching valves (553F1 and 553F2) by which oil is supplied and discharged to and from the arm cylinder 23F is two, and the number of the boom direction switching valves (553E1 and 553E2) by which oil is supplied and discharged to and from the boom cylinder 23E is two. As a result, in the known technology, the number of the direction switching valves in the entirety of the hydraulic circuit 530 is ten. In the meanwhile, in the present embodiment, as shown in FIG. 5, the number of the direction switching valves in the entirety of the hydraulic circuit 30 is eight.

In addition to the above, as shown in FIG. 11, the known construction machine 501 is arranged such that the two arm direction switching valves (553F1 and 553F2) are connected with each other by an external pipe 561 (which is a pipe outside of the hydraulic circuit 530). Furthermore, the two boom direction switching valves (553E1 and 553E2) are connected with each other by an external pipe 562. In the meanwhile, as shown in FIG. 5, because in the present embodiment the number of the arm direction switching valve 53F is one and the number of the boom direction switching valve 53E is one, the external pipe 561 and the external pipe 562 shown in FIG. 11 are unnecessary. Cost reduction is therefore achieved in the hydraulic circuit 30 for construction machinery, as compared to cases where the external pipe 561 or 562 is necessary.

(Effect 2 (Invention 2))

[Configuration 2] The third actuator (23E or 23F) shown in FIG. 1 is a boom cylinder 23E. The third direction switching valve (53E or 53F) is a boom direction switching valve 53E. The third supply passage 43 is a boom supply passage 43E.

As compared to the right running motor 21A, the left running motor 22B, the bucket cylinder 22C, and the turning motor 21D, the boom cylinder 23E requires a large amount of oil for operation. According to the [Configuration 2] above, oil ejected from the two pumps (the first pump 11 and the second pump 12) is supplied to the boom cylinder 23E which requires a large amount of oil. The boom is therefore properly driven as compared to a case where oil ejected from only one pump (11 or 12) is supplied to the boom cylinder 23E.

(Effect 3 (Invention 3))

[Configuration 3] The first direction switching valves (51A and 51D) are formed of the right running direction switching valve 51A (one running direction switching valve) and the turning direction switching valve 51D. The second direction switching valves (52B and 52C) are formed of the left running direction switching valve 523 (the other running direction switching valve) and the bucket direction switching valve 52C.

The hydraulic circuit 30 for construction machinery includes the [Configuration 2] and the [Configuration 3] above. The oil ejected from the first pump 11 is therefore supplied to the right running direction switching valve 51A, the turning direction switching valve 51D, and the boom direction switching valve 53E (see the [Configuration 2] above). The oil ejected from the second pump 12 is supplied to the left running direction switching valve 52B, the bucket direction switching valve 52C, and the boom direction switching valve 53E. As such, the cost for the boom direction switching valve 53E is reduced while oil is supplied from the two pumps (11 and 12) to different direction switching valves.

(Effect 4 (Invention 5))

[Configuration 4] As shown in FIG. 2, at the boom down (see the boom down position 53Ec), the boom direction switching valve 53E maintains only one of the first unloading passage 31 and the second unloading passage 32 (the first unloading passage 31 in FIG. 2) to be in the full-opened state.

With the [Configuration 4], in the unloading passage (the first unloading passage 31 or the second unloading passage 32) maintained to be in the full-opened state, pressure due to the boom down operation is not generated. Unnecessary power consumption is therefore restrained.

(Effect 5 (Invention 6))

[Configuration 5] At the boom down (see the boom down position 53Ec), oil is supplied to the boom supply passage 43E from only one of the first supply passage 41 and the second supply passage 42 (the first supply passage 41 in FIG. 2).

At the boom down, the boom cylinder 23E is not loaded and the weight of the boom is applied to the boom cylinder 23E. On this account, when oil is supplied to the boom supply passage 43E from both of the first supply passage 41 and the second supply passage 42 at the boom down, the boom down operation (i.e., the operation of the boom cylinder 23E) may be too quick. On this account, the hydraulic circuit 30 for construction machinery is provided with the [Configuration 5] above. This restrains the boom down operation from being too quick.

(Effect 6 (Invention 7))

[Configuration 6] In the boom direction switching valve 53E shown in FIG. 1, the opening degree of the first unloading passage 31 is different from the opening degree of the second unloading passage 32 (see FIG. 4).

On account of the [Configuration 6], one of the flow rate of oil flowing from the first supply passage 41 to the boom direction switching valve 53E and the flow rate of oil flowing from the second supply passage 42 to the boom direction switching valve 53E is arranged to be smaller than the other. Therefore [Effect 6-1] and [Effect 6-2] below are exerted. [Effect 6-1] As compared to a case where oil is supplied from the first supply passage 41 and the second supply passage 42 to the boom direction switching valve 53E at the same flow rate, fine adjustment of the flow rate of the oil supplied to the boom direction switching valve 53E is facilitated. This makes it possible to easily perform a fine operation of the boom cylinder 23E.

[Effect 6-2] It is possible to adjust the amount of oil supplied to a direction switching valve other than the boom direction switching valve 53E having the [Configuration 6] above. To be more specific, assume that the flow rate of the oil supplied from the second supply passage 42 to the boom direction switching valve 53E is arranged to be lower than the flow rate of the oil supplied from the first supply passage 41 to the boom direction switching valve 53E. In this case, as compared to an actuator (e.g., the first actuators (21A and 21D)) using oil on the first supply passage 41, oil is easily supplied to an actuator (e.g., the second actuators (22B and 22C)) using oil on the second supply passage 42.

(Effect 7 (Invention 8))

[Configuration 7] The third actuator (23E or 23F) is the arm cylinder 23F. The third direction switching valve (53E or 53F) is the arm direction switching valve 53F. The third supply passage 43 is the arm supply passage 43F.

As compared to the right running motor 21A, the left running motor 22B, the bucket cylinder 22C, and the turning motor 21D, the arm cylinder 23F requires a large amount of oil for operation. According to the [Configuration 7] above, oil ejected from the two pumps (the first pump 11 and the second pump 12) is supplied to the arm cylinder 23F which requires a large amount of oil. The arm is therefore suitably driven as compared to a case where oil ejected from only one pump (11 or 12) is supplied to the arm cylinder 23F.

(Effect 8 (Invention 9))

[Configuration 8] The first direction switching valves (51A and 51D) are formed of the right running direction switching valve 51A (one running direction switching valve) and the turning direction switching valve 51D. The second direction switching valves (52B and 52C) are formed of the left running direction switching valve 52B (the other running direction switching valve) and the bucket direction switching valve 52C.

The hydraulic circuit 30 for construction machinery is provided with the [Configuration 7] above and the [Configuration 8] above (identical with the [Configuration 3] above). For this reason, the cost for the arm direction switching valve 53F is reduced while oil is supplied from the two pumps (11 and 12) to different direction switching valves.

(Effect 9 (Invention 10))

[Configuration 9-1] The arm direction switching valve 53F is provided on the downstream of other direction switching valves ((51A, 52B, 52C, 51D, and 53E) on the upstream of the arm direction switching valve 53F).

[Configuration 9-2a] The first supply passage 41 (e.g., the first arm junction passage 41Fa) is connected with the first unloading passage 31 at a position between another direction switching valve (e.g., the turning direction switching valve 51D) and the arm direction switching valve 53F (see the connection position 41Fa-1).

[Configuration 9-2b] Alternatively, the second supply passage 42 (e.g., the second arm junction passage 42Fa) is connected with the second unloading passage 32 at a position between another direction switching valve (e.g., the boom direction switching valve 53E) and the arm direction switching valve 53F (see e.g., the connection position 42Fa-1).

Thanks to the [Configuration 9-1] and [Configuration 9-2a] above, redundant oil at another direction switching valve (the turning direction switching valve 51D in FIG. 1) is supplied to the arm direction switching valve 53F via the first supply passage 41 (e.g., the first arm junction passage 41Fa). The oil ejected from the first pump 11 is effectively utilized in this way. Alternatively, thanks to the [Configuration 9-1] and [Configuration 9-2a] above, redundant oil at another direction switching valve (the boom direction switching valve 53E in FIG. 1) is supplied to the arm direction switching valve 53F via the second supply passage 42 (e.g., the second arm junction passage 42Fa). The oil ejected from the second pump 12 is effectively utilized in this way.

(Effect 10 (Invention 11))

[Configuration 10] In the arm direction switching valve 53F, the opening degree of the first unloading passage 31 is different from the opening degree of the second unloading passage 32 (see FIG. 4).

On account of the [Configuration 10], one of the flow rate of oil flowing from the first supply passage 41 to the arm direction switching valve 53F and the flow rate of oil flowing from the second supply passage 42 to the arm direction switching valve 53F is arranged to be smaller than the other. Therefore [Effect 10-1] and [Effect 10-2] below are exerted.

[Effect 10-1] As compared to a case where oil is supplied from the first supply passage 41 and the second supply passage 42 to the arm direction switching valve 53F at the same flow rate, fine adjustment of the flow rate of the oil supplied to the arm direction switching valve 53F is facilitated. This makes it possible to easily perform a fine operation of the arm cylinder 23F.

[Effect 10-2] It is possible to adjust the amount of oil supplied to a direction switching valve other than the arm direction switching valve 53F having the [Configuration 10] above. To be more specific, assume that the flow rate of the oil supplied from the second supply passage 42 to the arm direction switching valve 53F is arranged to be lower than the flow rate of the oil supplied from the first supply passage 41 to the arm direction switching valve 53F. In this case, as compared to an actuator (e.g., the first actuators (21A and 21D)) using oil on the first supply passage 41, oil is easily supplied to an actuator (e.g., the second actuators (22B and 22C)) using oil on the second supply passage 42.

(Effect 11 (Invention 12))

The hydraulic circuit 30 for construction machinery includes the boom supply passage 43E, the boom direction switching valve 53E, the arm supply passage 43F, and the arm direction switching valve 53F.

[Configuration 11-1] The boom supply passage 43E is connected with the first supply passage 41 and the second supply passage 42. The boom direction switching valve 53E is connected with the boom supply passage 43E, the first unloading passage 31, the second unloading passage 32, and the tank passage 35, and supplies and discharges oil to and from the boom cylinder 23E. [Configuration 11-2] The arm supply passage 43F is connected with the first supply passage 41 and the second supply passage 42. The arm direction switching valve 53F is connected with the arm supply passage 43F, the first unloading passage 31, the second unloading passage 32, and the tank passage 35, and supplies and discharges oil to and from the arm cylinder 23F.

By the [Configuration 11-1] and [Configuration 11-2] above, the number of direction switching valves (the boom direction switching valve 53E and the arm direction switching valve 53F) is reduced by one for each of two types of actuators (the boom cylinder 23E and the arm cylinder 23F), i.e., the number of direction switching valves is reduced by two in total. Cost for the direction switching valves (in the hydraulic circuit 30 for construction machinery) is therefore further reduced.

(Effect 12 (Invention 13))

[Configuration 12] The first direction switching valves (51A and 51D) are formed of the right running direction switching valve 51A (one running direction switching valve) and the turning direction switching valve 51D. The second direction switching valves (52B and 52C) are formed of the left running direction switching valve 52B (the other running direction switching valve) and the bucket direction switching valve 52C.

The hydraulic circuit 30 for construction machinery is provided with the [Configuration 11-1] and [Configuration 11-2] above and the [Configuration 12] above (identical with the [Configuration 3] above). For this reason, the cost for the boom direction switching valve 53E and the arm direction switching valve 53F is reduced while oil is supplied from the two pumps (11 and 12) to different direction switching valves.

(Effect 13 (Invention 14))

The first supply passage 41 is provided with the first supply main line passage 41*a* and the first arm branched passage 41F.

[Configuration 13-1] The first supply main line passage 41*a* is able to supply oil to the arm direction switching valve 53F and the turning direction switching valve 51D.

[Configuration 13-2] The first arm branched passage 41F connects the first supply main line passage 41α with the arm supply passage 43F.

[Configuration 13-3] On the first arm branched passage 41F, the first throttle 71 is provided.

Thanks to the [Configuration 13-1] to [Configuration 13-3] above, oil on the first supply main line passage 41α is more preferentially supplied to the turning direction switching valve 51D than to the arm direction switching valve 53F. As a result, pressure decrease at the turning direction switching valve 51D is restrained. It is therefore easy to secure the torque of an actuator (turning motor 21D) connected with the turning direction switching valve 51D. To be more specific, the starting torque at the start of the turning (described above) is easily secured.

(Effect 14 (Invention 15))

The boom direction switching valve 53E is on the downstream of the turning direction switching valve 51D. The arm direction switching valve 53F is on the downstream of the boom direction switching valve 53E. The hydraulic circuit 30 for construction machinery is provided with the first arm junction passage 41Fa.

[Configuration 14-1] The first arm junction passage 41Fa connects the first unloading passage 31 with the arm supply passage 43F.

[Configuration 14-2] The first arm junction passage 41Fa is connected with the first unloading passage 31 at a position between the turning direction switching valve 51D and the boom direction switching valve 53E.

[Configuration 14-3] The first arm junction passage 41Fa is connected with the arm supply passage 43F at a position between the first throttle 71 and the arm direction switching valve 53F.

When the first throttle 71 of the [Configuration 13-3] above is provided, oil supply from the first arm branched passage 41F to the arm direction switching valve 53F may be insufficient. The hydraulic circuit 30 for construction machinery is therefore provided with the first arm junction passage 41Fa of the [Configuration 14-1] to [Configuration 14-3] above. The redundant oil at the turning direction switching valve 51D is therefore supplied to the arm supply passage 43F via the first arm junction passage 41Fa. It is therefore easy to secure a sufficient amount of oil supplied to the arm direction switching valve 53F. For example, when an actuator (turning motor 21D) connected with the turning direction switching valve 51D is not driven (or not substantially driven), it is easy to secure a sufficient amount of oil supplied to the arm direction switching valve 53F.

(Effect 15 (Invention 17))

The second supply passage 42 is provided with the second supply main line passage 42α and the second arm branched passage 42F.

[Configuration 15-1] The second supply main line passage 42α is able to supply oil to the boom direction switching valve 53E and the arm direction switching valve 53F.

[Configuration 15-2] The second arm branched passage 42F connects the second supply main line passage 42α with the second arm branched passage 42F.

[Configuration 15-3] On the second arm branched passage 42F, the second throttle 72 is provided.

Thanks to the [Configuration 15-1] to [Configuration 15-3] above, oil on the second supply main line passage 42α is more preferentially supplied to the boom direction switching valve 53E than to the arm direction switching valve 53F. It is therefore possible to more preferentially drive the boom cylinder 23E than the arm cylinder 23F.

(Effect 16 (Invention 18))

The arm direction switching valve 53F is on the downstream of the boom direction switching valve 53E. The hydraulic circuit 30 for construction machinery is provided with the second arm junction passage 42Fa.

[Configuration 16-1] The second arm junction passage 42Fa connects the second unloading passage 32 with the arm supply passage 43F.

[Configuration 16-2] The second arm junction passage 42Fa is connected with the second unloading passage 32 at a position between the boom direction switching valve 53E and the arm direction switching valve 53F.

[Configuration 16-3] The second arm junction passage 42Fa is connected with the arm supply passage 43F at a position between the second throttle 72 and the arm direction switching valve 53F.

When the second throttle 72 of the [Configuration 15-3] above is provided, oil supply from the second arm branched passage 42F to the arm direction switching valve 53F may be insufficient. The hydraulic circuit 30 for construction machinery is therefore provided with the second arm junction passage 42Fa of the [Configuration 16-1] to [Configuration 16-3] above. The redundant oil at the boom direction switching valve 53E is therefore supplied to the arm supply passage 43F via the second arm junction passage 42Fa. It is therefore easy to secure a sufficient amount of oil supplied to the arm direction switching valve 53F.

(Effect 17 (Invention 23))

[Configuration 17] In the boom direction switching valve 53E, the opening degree of the first unloading passage 31 (see "P1→T" in FIG. 4) is different from the opening degree of the second unloading passage 32 (see "P2→T" in FIG. 4).

On account of the [Configuration 17], one of the flow rate of oil flowing from the first supply passage 41 shown in FIG. 1 to the boom direction switching valve 53E and the flow rate of oil flowing from the second supply passage 42 to the boom direction switching valve 53E is arranged to be smaller than the other. Therefore [Effect 17-1] and [Effect 17-2] below are exerted.

[Effect 17-1] As compared to a case where oil is supplied from the first supply passage 41 and the second supply passage 42 to the boom direction switching valve 53E at the same flow rate, fine adjustment of the flow rate of the oil supplied to the boom direction switching valve 53E is facilitated. This makes it possible to easily perform a fine operation of the boom cylinder 23E.

[Effect 17-2] It is possible to adjust the amount of oil supplied to a direction switching valve other than the boom direction switching valve 53E. To be more specific, assume that the flow rate of the oil supplied from the second supply passage 42 to the boom direction switching valve 53E is arranged to be higher than the flow rate of the oil supplied from the first supply passage 41 to the boom direction switching valve 53E. In this case, as compared to an actuator (e.g., the second actuators (22B and 22C)) using oil on the second supply passage 42, oil is easily supplied to an actuator (e.g., the first actuators (21A and 21D)) using oil on the first supply passage 41.

(Effect 18 (Invention 24))

[Configuration 18] In the arm direction switching valve 53F, the opening degree of the first unloading passage 31 (see "P1→T" in FIG. 4) is different from the opening degree of the second unloading passage 32 (see "P2→T" in FIG. 4).

On account of the [Configuration 18], one of the flow rate of oil flowing from the first supply passage 41 shown in FIG. 1 to the arm direction switching valve 53F and the flow rate of oil flowing from the second supply passage 42 to the arm direction switching valve 53F is arranged to be smaller than the other. Therefore [Effect 18-1] and [Effect 18-2] below are exerted.

[Effect 18-1] As compared to a case where oil is supplied from the first supply passage 41 and the second supply passage 42 to the arm direction switching valve 53F at the same flow rate, fine adjustment of the flow rate of the oil supplied to the arm direction switching valve 53F is facilitated. This makes it possible to easily perform a fine operation of the arm cylinder 23F.

[Effect 18-2] It is possible to adjust the amount of oil supplied to a direction switching valve other than the arm direction switching valve 53F. To be more specific, assume that the flow rate of the oil supplied from the second supply passage 42 to the arm direction switching valve 53F is arranged to be lower than the flow rate of the oil supplied from the first supply passage 41 to the arm direction switching valve 53F. In this case, as compared to an actuator (e.g., the first actuators (21A and 21D)) using oil on the first supply passage 41, oil is easily supplied to an actuator (e.g., the second actuators (22B and 22C)) using oil on the second supply passage 42.

Second Embodiment

Figure 6:
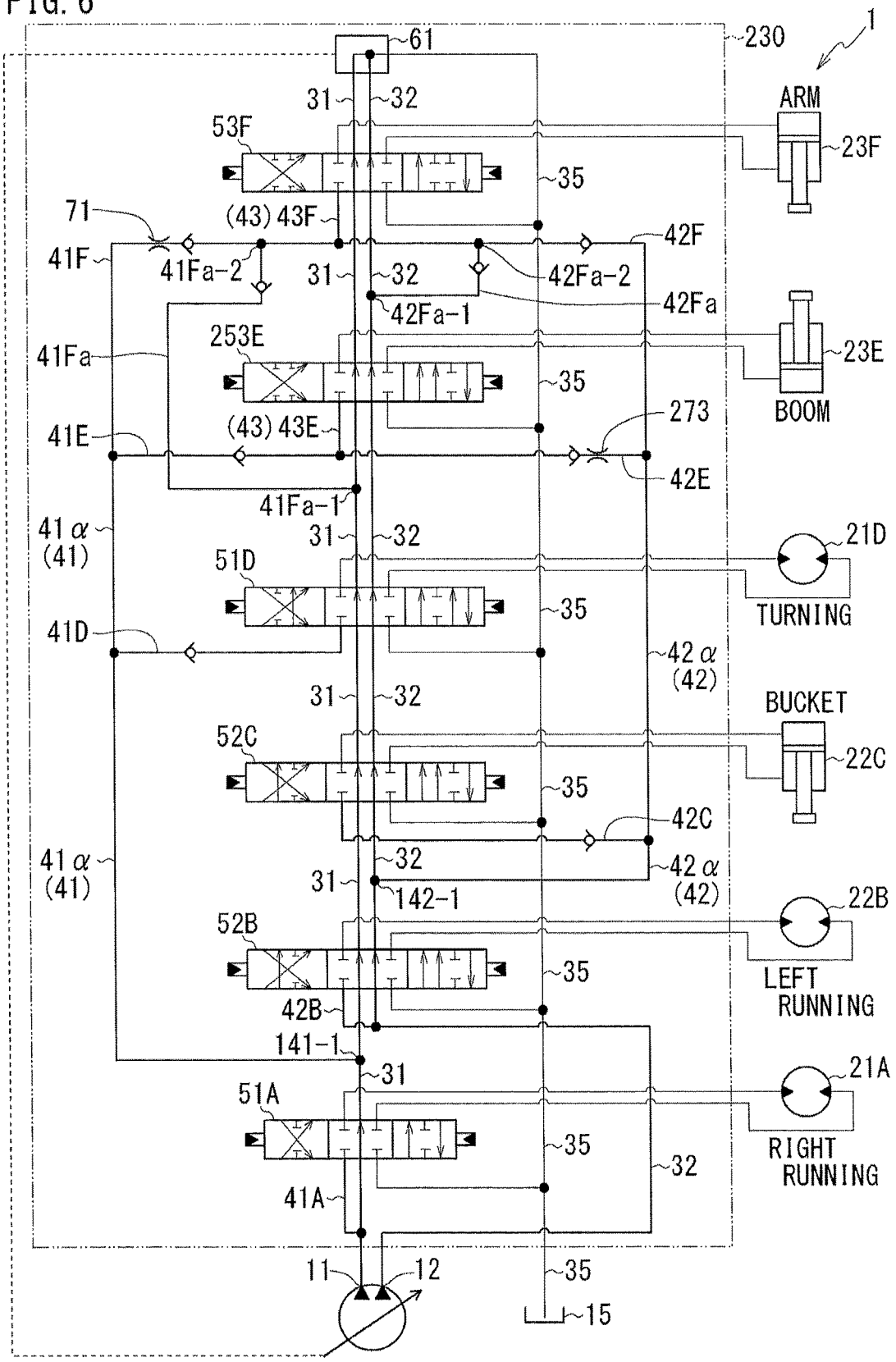
FIG. 6 relates to Second Embodiment and is equivalent to FIG. 1.
Figure 7:
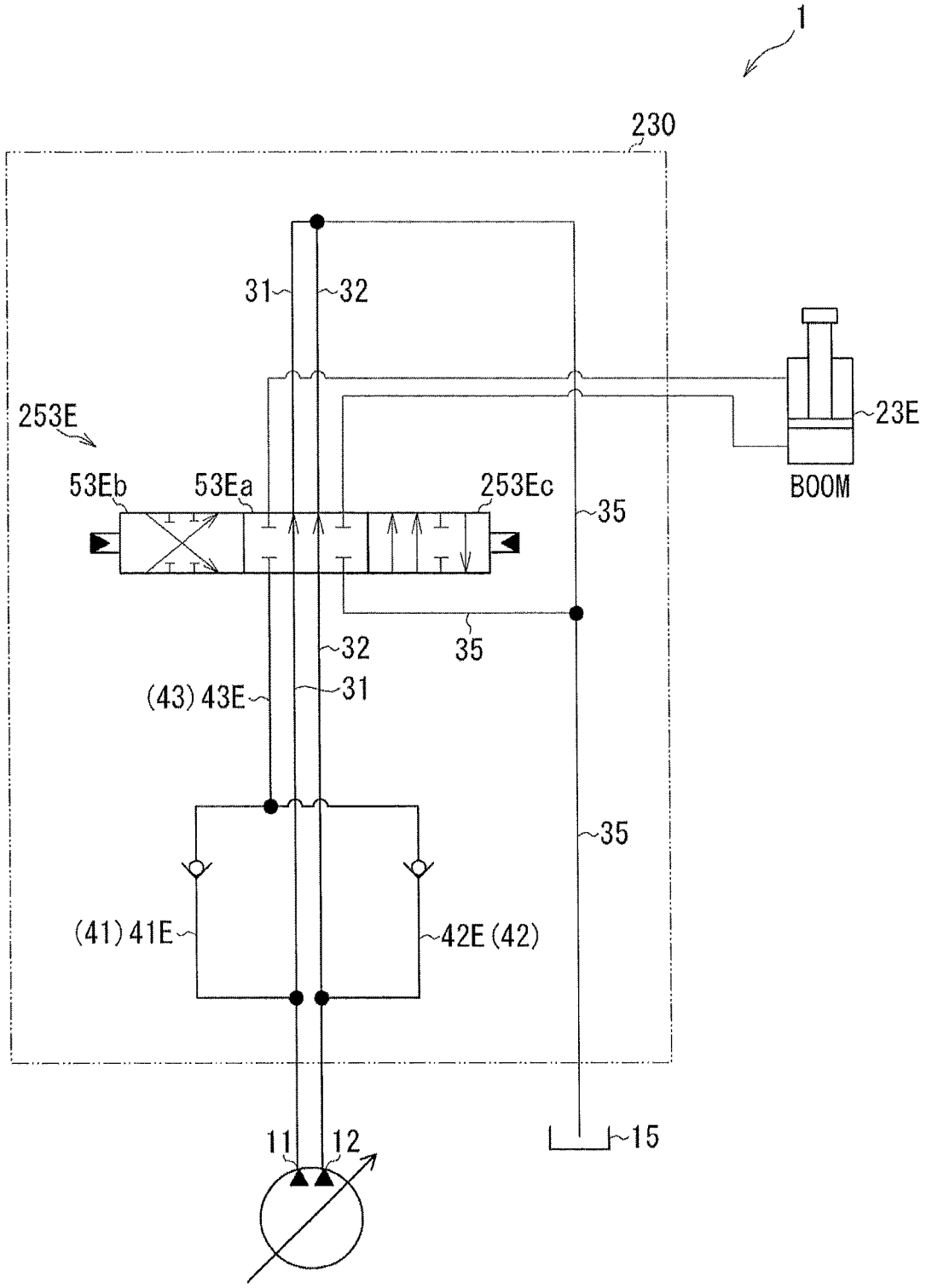
FIG. 7 is a hydraulic circuit diagram of a boom direction switching valve 253E and the like shown in FIG. 6.

With reference to FIG. 6 and FIG. 7, differences between a hydraulic circuit 230 for construction machinery of Second Embodiment and the hydraulic circuit of First Embodiment will be described. In regard to the hydraulic circuit 230 for construction machinery, same reference numbers are attached to members identical with those in First Embodiment. The differences between First Embodiment and Second Embodiment are as follows. (a) A connection position 141-1 shown in FIG. 6 at which the first supply passage 41 is connected with the first unloading passage 31. (b) A connection position 142-1 at which the second supply passage 42 is connected with the second unloading passage 32. (c) The arrangement around a boom down position 253Ec of a boom direction switching valve 253E shown in FIG. 7. (d) A third throttle 273 shown in FIG. 6.

(Connection Position 141-1)

As shown in FIG. 1, in First Embodiment, the connection position 41-1 where the first supply passage 41 is connected with the first unloading passage 31 is at the most upstream part of the first unloading passage 31 (i.e., on the upstream of the right running direction switching valve 51A). As shown in FIG. 6, in Second Embodiment, the connection position 141-1 where the first supply passage 41 (except the right running branched passage 41A) is connected with the first unloading passage 31 is a position where oil ejected from the first pump 11 is most preferentially supplied to the right running direction switching valve 51A. To be more specific, the connection position 114-1 is on the downstream of the right running direction switching valve 51A. The connection position 141-1 is between the arm direction switching valve 53F and another direction switching valve (i.e., a direction switching valve on the upstream of the arm direction switching valve 53F). The connection position 141-1 is between the boom direction switching valve 253E and another direction switching valve (i.e., a direction switching valve on the upstream of the boom direction switching valve 253E). The connection position 141-1 is between the right running direction switching valve 51A and the left running direction switching valve 52E (an outlet part of the right running direction switching valve 51A).

(Connection Position 142-1)

As shown in FIG. 1, in First Embodiment, the connection position 42-1 where the second supply passage 42 is connected with the second unloading passage 32 is at the most upstream part of the second unloading passage 32 (i.e., on the upstream of the left running direction switching valve 52B). As shown in FIG. 6, in Second Embodiment, the connection position 142-1 where the second supply passage 42 (except the left running branched passage 42B) is connected with the second unloading passage 32 is a position where oil ejected from the second pump 12 is most preferentially supplied to the left running direction switching valve 52B. To be more specific, the connection position 142-1 is on the downstream of the left running direction switching valve 52B. The connection position 142-1 is between the arm direction switching valve 53F and another direction switching valve (i.e., a direction switching valve on the upstream of the arm direction switching valve 53F). The connection position 142-1 is between the boom direction switching valve 253E and another direction switching valve (i.e., a direction switching valve on the upstream of the boom direction switching valve 253E). The connection position 142-1 is between the left running direction switching valve 52B and the bucket branched passage 42C (an outlet part of the right running direction switching valve 52B).

(Boom Down Position 253Ec)

As shown in FIG. 2, in First Embodiment, at the boom down position 53Ec, the first unloading passage 31 is in the full-opened state (maintained to be in the full-opened state) and the second unloading passage 32 is in the cutoff state or the throttled state. Furthermore, at the boom down position 53Ec, the boom supply passage 43E (third supply passage 43) is in the cutoff state and the boom-down branched passage 42E1 (second supply passage 42) and the tank passage 35 are in the connection state (the full-opened state or the throttled state).

As shown in FIG. 7, in Second Embodiment, at the boom down position 253Ec, the first unloading passage 31 is in the full-opened state (maintained to be in the full-opened state) and the second unloading passage 32 is in the cutoff state or the throttled state in the same manner as in First Embodiment. Furthermore, being different from First Embodiment, at the boom down position 253Ec, the boom supply passage 43E (third supply passage 43) and the tank passage 35 are in the connection state (the full-opened state or the throttled state). With this arrangement, as in First Embodiment, oil is supplied to the boom cylinder 23E only from the second supply passage 42 among the first supply passage 41 and the second supply passage 42. In the hydraulic circuit 230 for construction machinery, the boom-down branched passage 42E1 shown in FIG. 1 is unnecessary. To put it differently, it can be seen that the boom-down branched passage 42E1 (see FIG. 1) and the second boom branched passage 42E are arranged to be (function as) a single passage.

As shown in FIG. 6, the third throttle 273 is provided in the second boom branched passage 42E. The third throttle 273 is provided to more preferentially supply oil in the second supply passage 42 to the arm direction switching valve 53F than to the boom direction switching valve 253E. In Second Embodiment, the second throttle 72 (which is a throttle provided on the second arm branched passage 42F) shown in FIG. 1 is not provided. In the hydraulic circuit 230 for construction machinery shown in FIG. 6, when the boom-down branched passage 42E1 shown in FIG. 1 is provided (not shown in the figure), the third throttle 273 shown in FIG. 6 may be provided in the boom-down branched passage 42E1 (see FIG. 1).

(Effect 19 (Invention 4))

An effect of the hydraulic circuit 230 for construction machinery shown in FIG. 6 will be described.

[Configuration 19-1] The boom direction switching valve 253E is provided on the downstream of another direction switching valve (i.e., the direction switching valves (51A, 52B, 52C, and 51D) on the upstream of the boom direction switching valve 53E).

[Configuration 19-2a] The first supply passage 41 is connected with the first unloading passage 31 at a position (e.g., the connection position 141-1) between another direction switching valve (e.g., the left running direction switching valve 52B) and the boom direction switching valve 253E.

[Configuration 19-2b] The second supply passage 42 is connected with the second unloading passage 32 at a position (e.g., the connection position 142-1) between another direction switching valve (e.g., the left running direction switching valve 52B) and the boom direction switching valve 253E.

By the [Configuration 19-1] and [Configuration 19-2a] above, redundant oil at another direction switching valve (e.g., the right running direction switching valve 51A) is supplied to the boom direction switching valve 253E via the first supply passage 41. The redundant oil of the first pump 11 is effectively utilized in this way. By the [Configuration 19-1] and [Configuration 19-2a] above, redundant oil at another direction switching valve (e.g., the left running direction switching valve 52B) is supplied to the boom direction switching valve 253E via the second supply passage 42. The redundant oil of the second pump 12 is effectively utilized in this way.

(Effect 20 (Invention 19))

The second supply passage 42 is provided with the second supply main line passage 42α and the second boom branched passage 42E.

[Configuration 20-1] The second supply main line passage 42α is able to supply oil to the boom direction switching valve 253E and the arm direction switching valve 53F.

[Configuration 20-2] The second boom branched passage 42E connects the second supply main line passage 42α with the boom supply passage 43E.

[Configuration 20-3] On the second boom branched passage 42E, the third throttle 273 is provided.

Thanks to the [Configuration 20-1] to [Configuration 20-3] above, oil on the second supply main line passage 42α is more preferentially supplied to the arm direction switching valve 53F than to the boom direction switching valve 253E. It is therefore possible to more preferentially drive the arm cylinder 23F than the boom cylinder 23E.

Third Embodiment

Figure 8:
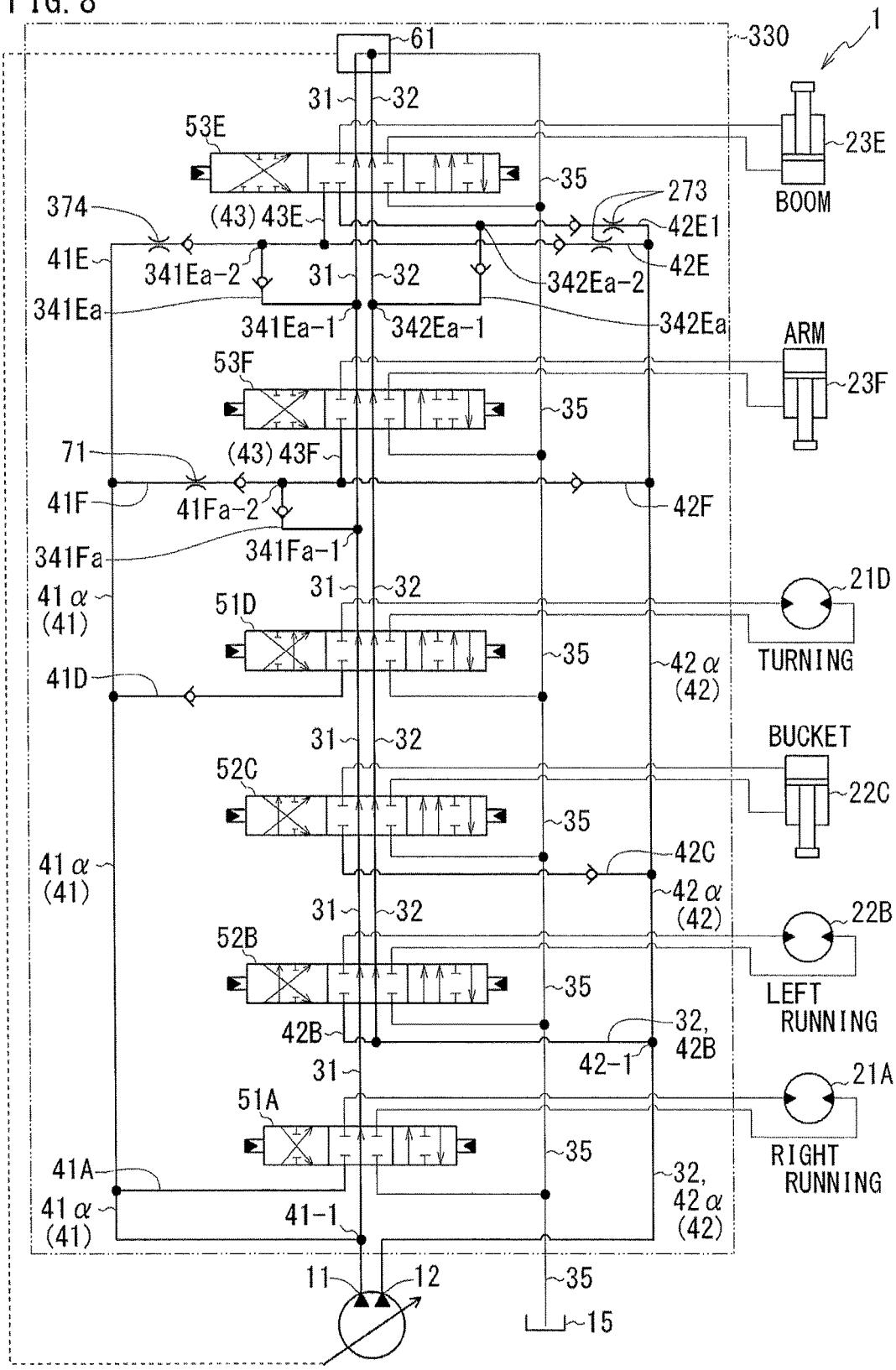
FIG. 8 relates to Third Embodiment and is equivalent to FIG. 1.

With reference to FIG. 8, differences between a hydraulic circuit 330 for construction machinery of Third Embodiment and the hydraulic circuit of First Embodiment will be described. In regard to the hydraulic circuit 330 for construction machinery, same reference numbers are attached to members identical with those in First Embodiment. The differences between First Embodiment and Third Embodiment are as follows.

(a) As shown in FIG. 1, in First Embodiment, the arm direction switching valve 53F is provided on the downstream of the boom direction switching valve 53E. As shown in FIG. 8, in Third Embodiment, the boom direction switching valve 53E is provided on the downstream of the arm direction switching valve 53F.

(b) The second arm junction passage 42Fa provided in First Embodiment as shown in FIG. 1 is not provided in Third Embodiment shown in FIG. 8.

(c) In Third Embodiment, a first boom junction passage 341Ea and a second boom junction passage 342Ea which are not in First Embodiment are provided.

(d) As compared to the first arm junction passage 41Fa of First Embodiment shown in FIG. 1, a first arm junction passage 341Fa of Third Embodiment shown in FIG. 8 is differently arranged.

(e) Being similar to Second Embodiment shown in FIG. 6, in Third Embodiment shown in FIG. 8, the third throttle 273 which is not included in First Embodiment is provided whereas the second throttle 72 (see FIG. 1) which is included in First Embodiment is not provided.

(f) In Third Embodiment, a fourth throttle 374 which is not included in First Embodiment is provided. The differences will be further described below.

The first boom junction passage 341Ea is a path for supplying oil (redundant oil) flowing in the first unloading passage 31 to the boom supply passage 43E (i.e., causing the redundant oil to join the boom supply passage 43E). The first boom junction passage 341Ea is connected with the first unloading passage 31 and the boom supply passage 43E. The first boom junction passage 341Ea is provided with a connection position 341Ea-1 and a connection position 341Ea-2.

The connection position 341Ea-1 is a connection position where the first boom junction passage 341Ea (first supply passage 41) is connected with the first unloading passage 31. The connection position 341Ea-1 is on the upstream of the boom direction switching valve 53E. To be more specific, the connection position 341Ea-1 is between the boom direction switching valve 53E and the arm direction switching valve 53F.

The connection position 341Ea-2 is a connection position where the first boom junction passage 341Ea is connected with the boom supply passage 43E. The first boom junction passage 341Ea may be connected with the boom supply passage 43E via the first boom branched passage 41E or the second boom branched passage 42E. The connection position 341Ea-2 is between the fourth throttle 374 (described later) and the boom direction switching valve 53E. The connection position 341Ea-2 is on the downstream of the fourth throttle 374 and on the upstream of the boom direction switching valve 53E. The connection position 341Ea-2 is provided between the third throttle 273 (the third throttle 273 on the second boom branched passage 42E) and the boom direction switching valve 53E. The connection position 341Ea-2 is on the downstream of the third throttle 273 and on the upstream of the boom direction switching valve 53E. The connection position 341Ea-2 is on the boom direction switching valve 53E side (downstream side) of a check valve provided on the first boom branched passage 41E and a check valve provided on the second boom branched passage 42E.

The second boom junction passage 342Ea is a path for supplying oil (redundant oil) flowing in the second unloading passage 32 to the boom supply passage 43E (i.e., causing the redundant oil to join the boom supply passage 43E). The second boom junction passage 342Ea is connected with the second unloading passage 32 and the boom-down branched passage 42E1. The second boom junction passage 342Ea is provided with a connection position 342Ea-1 and a connection position 342Ea-2.

The connection position 342Ea-1 is a connection position where the second boom junction passage 342Ea (second supply passage 42) is connected with the second unloading passage 32. The connection position 342Ea-1 is on the upstream of the boom direction switching valve 53E. To be more specific, the connection position 342Ea-1 is between the boom direction switching valve 53E and the arm direction switching valve 53F.

The connection position 342Ea-2 is a connection position where the second boom junction passage 342Ea is connected with the boom-down branched passage 42E1 (or a connection position with the second boom branched passage 42E). The connection position 342Ea-2 is between the third throttle 273 and the boom direction switching valve 53E. The connection position 342Ea-2 is on the downstream of the third throttle 273 and on the upstream of the boom direction switching valve 53E. The connection position 342Ea-2 is on the boom direction switching valve 53E side (downstream side) of a check valve provided on the boom-down branched passage 42E1.

In each of the first boom junction passage 341Ea and the second boom junction passage 342Ea, a check valve is provided.

(First Arm Junction Passage 341Fa) As shown in FIG. 1, in First Embodiment, the connection position 41Fa-1 where the first arm junction passage 41Fa (first supply passage 41) is connected with the first unloading passage 31 is provided between the turning direction switching valve 51D and the boom direction switching valve 53E. As shown in FIG. 8, in Third Embodiment, the connection position 341Fa-1 where the first arm junction passage 341Fa is connected with the first unloading passage 31 is between the turning direction switching valve 51D and the arm direction switching valve 53F.

The fourth throttle 374 is provided on the first boom branched passage 41E. The fourth throttle 374 is, being similar to the first throttle 71 shown in FIG. 1, provided to prevent decrease in the pressure in the first supply passage 41.

(Effect 21 (Invention 16))

An effect of the hydraulic circuit 330 for construction machinery shown in FIG. 8 will be described.

The arm direction switching valve 53F is on the downstream of the turning direction switching valve 51D. The boom direction switching valve 53E is on the downstream of the arm direction switching valve 53F. The hydraulic circuit 330 for construction machinery is provided with the first arm junction passage 341Fa.

[Configuration 21-1] The first arm junction passage 341Fa connects the first unloading passage 31 with the arm supply passage 43F.

[Configuration 21-2] The first arm junction passage 341Fa is connected with the first unloading passage 31 at a position between the turning direction switching valve 51D and the arm direction switching valve 53F.

[Configuration 21-3] The first arm junction passage 341Fa is connected with the arm supply passage 43F at a position between the first throttle 71 and the arm direction switching valve 53F.

When the first throttle 71 is provided on the first arm branched passage 41F, oil supply from the first arm branched passage 41F to the arm direction switching valve 53F may be insufficient. The hydraulic circuit 330 for construction machinery is therefore provided with the first arm junction passage 341Fa of the [Configuration 21-1] to [Configuration 21-3] above. The redundant oil at the turning direction switching valve 51D is therefore supplied to the arm direction switching valve 53F via the first arm junction passage 341Fa. It is therefore easy to secure a sufficient amount of oil supplied to the arm direction switching valve 53F.

(Effect 22 (Invention 21))

The first supply passage 41 is provided with the first supply main line passage 41α and the first boom branched passage 41E.

[Configuration 22-1] The first supply main line passage 41α is able to supply oil to the boom direction switching valve 53E and the arm direction switching valve 53F.

[Configuration 22-2] The first boom branched passage 41E connects the first supply main line passage 41α with the boom supply passage 43E.

[Configuration 22-3] On the first boom branched passage 41E, the fourth throttle 374 is provided.

Thanks to the [Configuration 22-1] to [Configuration 22-3] above, oil on the first supply main line passage 41α is more preferentially supplied to the turning direction switching valve 51D than to the arm direction switching valve 53F. As a result, pressure decrease at the turning direction switching valve 51D is restrained. It is therefore easy to secure the torque of an actuator (turning motor 21D) connected with the turning direction switching valve 51D. To be more specific, the starting torque at the start of the turning (described above) is easily secured.

(Effect 23 (Invention 22))

The arm direction switching valve 53F is on the downstream of the turning direction switching valve 51D. The boom direction switching valve 53E is on the downstream of the arm direction switching valve 53F. The hydraulic circuit 330 for construction machinery is provided with the first boom junction passage 341Ea.

[Configuration 23-1] The first boom junction passage 341Ea connects the first unloading passage 31 with the boom supply passage 43E.

[Configuration 23-2] The first boom junction passage 341Ea is connected with the second unloading passage 32 at a position between the arm direction switching valve 53F and the boom direction switching valve 53E.

[Configuration 23-3] The first boom junction passage 341Ea is connected with the boom supply passage 43E at a position between the fourth throttle 374 and the boom direction switching valve 53E.

When the fourth throttle 374 is provided as in the [Configuration 22-3] above, oil supply from the first boom branched passage 41E to the boom direction switching valve 53E may be insufficient. The hydraulic circuit 330 for construction machinery is therefore provided with the first boom junction passage 341Ea of the [Configuration 23-1] to [Configuration 23-3] above. The redundant oil at the arm direction switching valve 53F is therefore supplied to the boom direction switching valve 53E via the first boom junction passage 341Ea. It is therefore easy to secure a sufficient amount of oil supplied to the boom direction switching valve 53E.

Fourth Embodiment

Figure 9:
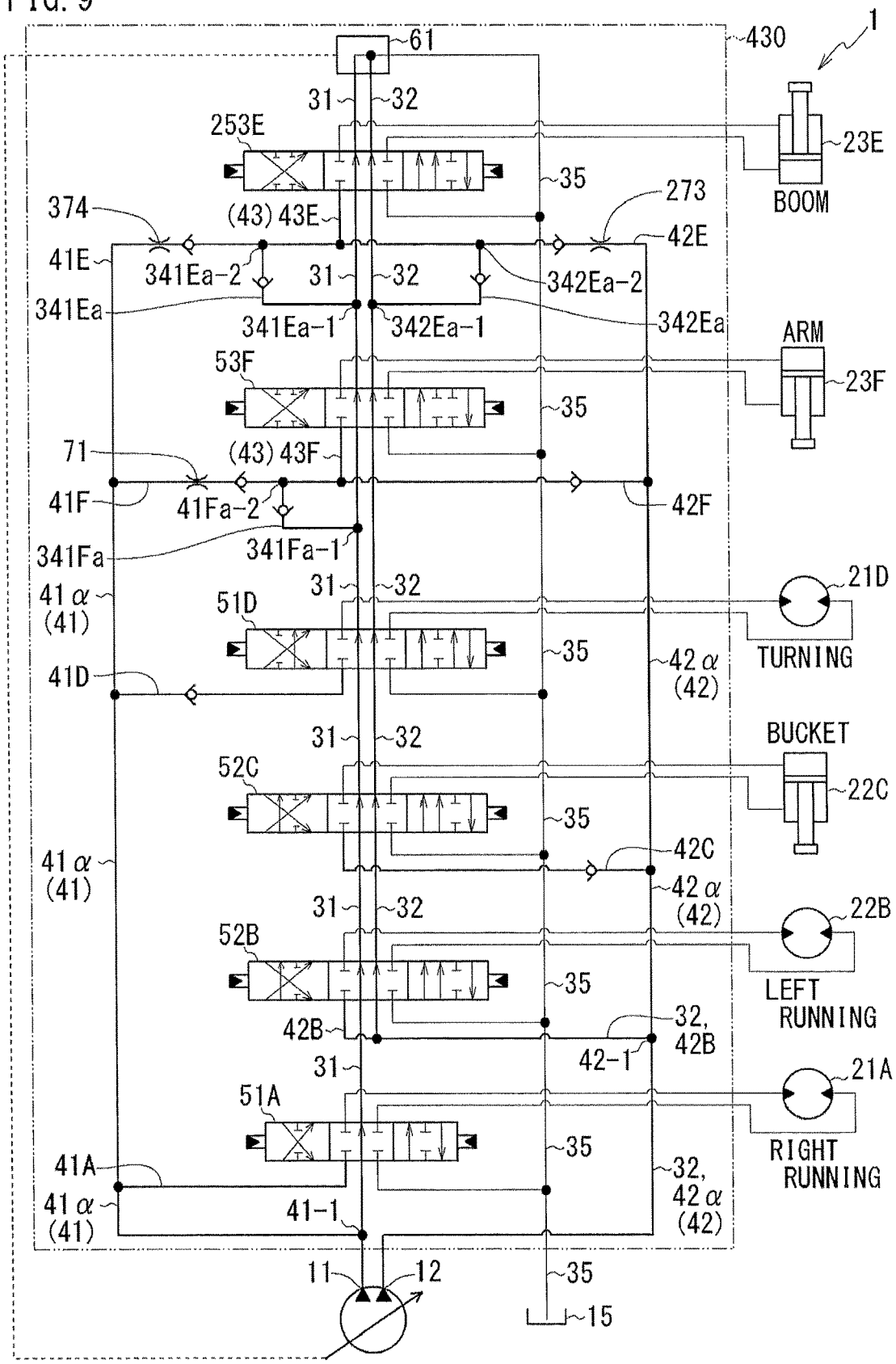
FIG. 9 relates to Fourth Embodiment and is equivalent to FIG. 1.

With reference to FIG. 9, differences between a hydraulic circuit 430 for construction machinery of Fourth Embodiment and the hydraulic circuit of Third Embodiment will be described. In regard to the hydraulic circuit 430 for construction machinery, same reference numbers are attached to members identical with those in Third Embodiment. The differences between Third Embodiment and Fourth Embodiment are as follows.

(a) As shown in FIG. 8, in Third Embodiment, the second boom branched passage 42E and the boom-down branched passage 42E1 are provided as different passages and the boom direction switching valve 53E identical with that in First Embodiment is provided. As shown in FIG. 9, in Fourth Embodiment, the boom-down branched passage 42E1 (shown in FIG. 8) and the second boom branched passage 42E are arranged to be (function as) a single passage, and the boom direction switching valve 253E similar to that in Second Embodiment is provided.

(b) As shown in FIG. 8, in Third Embodiment, the connection position 342Ea-2 is a connection position where the second boom junction passage 342Ea is connected with the boom-down branched passage 42E1. As shown in FIG. 9, in Fourth Embodiment, the connection position 342Ea-2 is a connection position where the second boom junction passage 342Ea is connected with the second boom branched passage 42E.

(c) As shown in FIG. 8, in Third Embodiment, the connection position 342Ea-2 is on the boom direction switching valve 53E side (downstream side) of a check valve provided on the boom-down branched passage 42E1. As shown in FIG. 9, in Fourth Embodiment, the connection position 342Ea-2 is on the boom direction switching valve 253E side (downstream side) of a check valve provided on the second boom branched passage 42E.

(Effect 24 (Invention 20))

An effect of the hydraulic circuit 430 for construction machinery shown in FIG. 9 will be described.

The arm direction switching valve 53F is on the downstream of the turning direction switching valve 51D. The boom direction switching valve 253E is on the downstream of the arm direction switching valve 53F. The hydraulic circuit 430 for construction machinery is provided with the second boom junction passage 342Ea.

[Configuration 22-1] The second boom junction passage 342Ea connects the second unloading passage 32 with the boom supply passage 43E.

[Configuration 22-2] The second boom junction passage 342Ea is connected with the second unloading passage 32 at a position between the arm direction switching valve 53F and the boom direction switching valve 253E.

[Configuration 22-3] The second boom junction passage 342Ea is connected with the boom supply passage 43E at a position between the third throttle 273 and the boom direction switching valve 253E.

When the third throttle 273 is provided on the second boom branched passage 42E, oil supply from the second boom branched passage 42E to the boom direction switching valve 253E may be insufficient. The hydraulic circuit 430 for construction machinery is therefore provided with the second boom junction passage 342Ea of the [Configuration 22-1] to [Configuration 22-3] above. The redundant oil at the arm direction switching valve 53F is therefore supplied to the boom direction switching valve 253E via the second boom junction passage 342Ea. It is therefore easy to secure a sufficient amount of oil supplied to the boom direction switching valve 253E.

(Other Modifications)

The embodiments above may be variously modified. For example, the circuits shown in FIG. 1 and the like may be suitably changed.

Example 1

For example, First to Fourth Embodiments may be suitably combined.

Example 1-1

For example, the second throttle 72 in First Embodiment shown in FIG. 1 may be omitted and the third throttle 273 of Second Embodiment shown in FIG. 6 may be added to First Embodiment.

Example 1-2

Furthermore, for example, the connection position 141-1 and the connection position 142-1 of Second Embodiment shown in FIG. 6 may be applied to Third Embodiment shown in FIG. 8 (i.e., the boom direction switching valve 53E is provided on the downstream of the arm supply passage 43F).

Example 2

Furthermore, for example, the boom direction switching valve 53E shown in FIG. 2 is arranged so that, at the boom down, oil is supplied to the boom cylinder 23E from only one of the first supply passage 41 and the second supply passage 42. Alternatively, the boom direction switching valve 53E may be arranged so that, at the boom down, oil is supplied to the boom cylinder 23E from both of the first supply passage 41 and the second supply passage 42.

Example 3

Furthermore, for example, the arm direction switching valve 53F shown in FIG. 3 is arranged so that, at the boom down, oil is supplied to the arm cylinder 23F from both of the first supply passage 41 and the second supply passage 42. Alternatively, the arm direction switching valve 53F may be arranged so that, at the boom down, oil is supplied to the arm cylinder 23F from only one of the first supply passage 41 and the second supply passage 42.

Example 4

Furthermore, for example, a check valve and/or a throttle not shown in FIG. 1 and the like may be added to paths (31 to 43).

REFERENCE SIGNS LIST

11 first pump
12 second pump
15 tank
21A right running motor
21D turning motor
22B left running motor
22C bucket cylinder
23E boom cylinder
23F arm cylinder
30, 230, 330, 430 hydraulic circuit for construction machinery
31 first unloading passage
32 second unloading passage
35 tank passage
41 first supply passage
41α first supply main line passage
41E first boom branched passage
41F first arm branched passage
41Fa, 341Fa first arm junction passage
42 second supply passage
42α second supply main line passage
42E second boom branched passage
42Fa second arm junction passage
43E boom supply passage
43F arm supply passage
51A right running direction switching valve (first direction switching valve, one running direction switching valve)
51D turning direction switching valve (first direction switching valve)
52B left running direction switching valve (second direction switching valve, the other running direction switching valve)
52C bucket direction switching valve (second direction switching valve)
53E, 253E boom direction switching valve
53F arm direction switching valve
71 first throttle
72 second throttle
273 third throttle
341Ea first boom junction passage
342Ea second boom junction passage
374 fourth throttle

The invention claimed is:

1. A hydraulic circuit for construction machinery, which is connected with a first pump, a second pump, a tank, and actuators, the hydraulic circuit comprising:

a first unloading passage connected with the first pump, the first unloading passage being arranged to return oil ejected from the first pump to the tank so as not to pass through the actuators;

a second unloading passage connected with the second pump, the second unloading passage being arranged to return oil ejected from the second pump to the tank so as not to pass through the actuators;

a first supply passage connected with the first pump;

a second supply passage connected with the second pump;

a tank passage connected with the first unloading passage, the second unloading passage, and the tank;

a first direction switching valve connected with the first supply passage, the first unloading passage, and the tank passage to supply and discharge oil to and from a first actuator;

a second direction switching valve connected with the second supply passage, the second unloading passage, and the tank passage to supply and discharge oil to and from a second actuator;

a third supply passage connected with the first supply passage and the second supply passage; and a third direction switching valve connected with the third supply passage, the first unloading passage, the second unloading passage, and the tank passage to supply and discharge oil to and from a third actuator.

2. The hydraulic circuit according to claim 1, wherein the third actuator is a boom cylinder, wherein the third direction switching valve is a boom direction switching valve, and wherein the third supply passage is a boom supply passage.

3. The hydraulic circuit according to claim 2, wherein the first direction switching valve is formed of one running direction switching valve and a turning direction switching valve, and wherein the second direction switching valve is formed of another running direction switching valve and a bucket direction switching valve.

4. The hydraulic circuit according to claim 3, wherein the boom direction switching valve is provided on the downstream of another direction switching valve, and wherein the first supply passage is connected with the first unloading passage at a position between the another direction switching valve and the boom direction switching valve or the second supply passage is connected with the second unloading passage at a position between the another direction switching valve and the boom direction switching valve.

5. The hydraulic circuit according to claim 2, wherein, at boom down, the boom direction switching valve maintains only one of the first unloading passage and the second unloading passage to be in a full-opened state.

6. The hydraulic circuit according to claim 2, wherein, at boom down, oil is supplied to the boom supply passage from only one of the first supply passage and the second supply passage.

7. The hydraulic circuit according to claim 2, wherein, in the boom direction switching valve, an opening degree of the second unloading passage is different from an opening degree of the first unloading passage.

8. The hydraulic circuit according to claim 1, wherein the third actuator is an arm cylinder, wherein the third direction switching valve is an arm direction switching valve, and wherein the third supply passage is an arm supply passage.

9. The hydraulic circuit according to claim 8, wherein the first direction switching valve is formed of one running direction switching valve and a turning direction switching valve, and wherein the second direction switching valve is formed of another running direction switching valve and a bucket direction switching valve.

10. The hydraulic circuit according to claim 9, wherein the arm direction switching valve is provided on the downstream of another direction switching valve, and wherein the first supply passage is connected with the first unloading passage at a position between the another direction switching valve and the arm direction switching valve or the second supply passage is connected with the second unloading passage at a position between the another direction switching valve and the arm direction switching valve.

11. The hydraulic circuit according to claim 8, wherein, in the arm direction switching valve, an opening degree of the first unloading passage is different from an opening degree of the second unloading passage.

12. A hydraulic circuit for construction machinery, which is connected with a first pump, a second pump, a tank, and actuators, the hydraulic circuit comprising:

a first unloading passage connected with the first pump, the first unloading passage being arranged to return oil ejected from the first pump to the tank so as not to pass through the actuators;

a second unloading passage connected with the second pump, the second unloading passage being arranged to return oil ejected from the second pump to the tank so as not to pass through the actuators;

a first supply passage connected with the first pump;

a second supply passage connected with the second pump;

a tank passage connected with the first unloading passage, the second unloading passage, and the tank;

a first direction switching valve connected with the first supply passage, the first unloading passage, and the tank passage to supply and discharge oil to and from a first actuator;

a second direction switching valve connected with the second supply passage, the second unloading passage, and the tank passage to supply and discharge oil to and from a second actuator;

a boom supply passage connected with the first supply passage and the second supply passage;

a boom direction switching valve connected with the boom supply passage, the first unloading passage, the second unloading passage, and the tank passage to supply and discharge oil to and from a boom cylinder;

an arm supply passage connected with the first supply passage and the second supply passage; and an arm direction switching valve connected with the arm supply passage, the first unloading passage, the second unloading passage, and the tank passage to supply and discharge oil to and from an arm cylinder.

13. The hydraulic circuit according to claim 12, wherein the first direction switching valve is formed of one running direction switching valve and a turning direction switching valve, and wherein the second direction switching valve is formed of another running direction switching valve and a bucket direction switching valve.

14. The hydraulic circuit according to claim 13, wherein the first supply passage includes:

a first supply main line passage configured to supply oil to the arm direction switching valve and the turning direction switching valve;

a first arm branched passage connecting the first supply main line passage with the arm supply passage; and a first throttle is provided on the first arm branched passage.

15. The hydraulic circuit according to claim 14, wherein the boom direction switching valve is provided on the downstream of the turning direction switching valve, wherein the arm direction switching valve is provided on the downstream of the boom direction switching valve, a first arm junction passage is provided to connect the first unloading passage with the arm supply passage, wherein the first arm junction passage is connected with the first unloading passage at a position between the turning direction switching valve and the boom direction switching valve, and wherein the first arm junction passage is connected with the arm supply passage at a position between the first throttle and the arm direction switching valve.

16. The hydraulic circuit according to claim 14, wherein the arm direction switching valve is provided on the downstream of the turning direction switching valve, wherein the boom direction switching valve is provided on the downstream of the arm direction switching valve, a first arm junction passage is provided to connect the first unloading passage with the arm supply passage, wherein the first arm junction passage is connected with the first unloading passage at a position between the turning direction switching valve and the arm direction switching valve, and wherein the first arm junction passage is connected with the arm supply passage at a position between the first throttle and the arm direction switching valve.

17. The hydraulic circuit according to claim 13, wherein the second supply passage includes:

a second supply main line passage configured to supply oil to the boom direction switching valve and the arm direction switching valve;

a second arm junction passage connecting the second supply main line passage with the arm supply passage; and a second throttle is provided on the second arm junction passage.

18. The hydraulic circuit according to claim 17, wherein the arm direction switching valve is provided on the downstream of the boom direction switching valve, a second arm junction passage is provided to connect the second unloading passage with the arm supply passage, wherein the second arm junction passage is connected with the second unloading passage at a position between the boom direction switching valve and the arm direction switching valve, and wherein the second arm junction passage is connected with the arm supply passage at a position between the second throttle and the arm direction switching valve.

19. The hydraulic circuit according to claim 13, wherein the second supply passage includes:

a second supply main line passage configured to supply oil to the boom direction switching valve and the arm direction switching valve;

a second boom branched passage connecting the second supply main line passage with the boom supply passage, and a third throttle is provided on the second boom branched passage.

20. The hydraulic circuit according to claim 19, wherein the arm direction switching valve is provided on the downstream of the turning direction switching valve, wherein the boom direction switching valve is provided on the downstream of the arm direction switching valve, a second boom junction passage is provided to connect the second unloading passage with the boom supply passage, wherein the second arm junction passage is connected with the second unloading passage at a position between the arm direction switching valve and the boom direction switching valve, and wherein the second boom junction passage is connected with the boom supply passage at a position between the third throttle and the boom direction switching valve.

21. The hydraulic circuit according to claim 13, wherein the first supply passage includes:

a first supply main line passage configured to supply oil to the boom direction switching valve and the arm direction switching valve;

a first boom branched passage connecting the first supply main line passage with the boom supply passage, and a fourth throttle is provided on the first boom branched passage.

22. The hydraulic circuit according to claim 21, wherein the arm direction switching valve is provided on the downstream of the turning direction switching valve, wherein the boom direction switching valve is provided on the downstream of the arm direction switching valve, a first boom junction passage is provided to connect the first unloading passage with the boom supply passage, wherein the first boom junction passage is connected with the second unloading passage at a position between the arm direction switching valve and the boom direction switching valve, and wherein the first boom junction passage is connected with the boom supply passage at a position between the fourth throttle and the boom direction switching valve.

23. The hydraulic circuit according to claim 12, wherein, in the boom direction switching valve, an opening degree of the second unloading passage is different from an opening degree of the first unloading passage.

24. The hydraulic circuit according to claim 12, wherein, in the arm direction switching valve, an opening degree of the first unloading passage is different from an opening degree of the second unloading passage.

* * * * *